US007580788B2

(12) United States Patent
Hiruta et al.

(10) Patent No.: US 7,580,788 B2
(45) **Date of Patent: *Aug. 25, 2009**

(54) TRAFFIC INFORMATION INTERPOLATION SYSTEM

(75) Inventors: Tomoaki Hiruta, Hitachi (JP); Masatoshi Kumagai, Hitachi (JP); Koichiro Tanikoshi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 26 days.

This patent is subject to a terminal disclaimer.

(21) Appl. No.: 11/937,668

(22) Filed: Nov. 9, 2007

(65) Prior Publication Data

US 2008/0114529 A1 May 15, 2008

(30) Foreign Application Priority Data

Nov. 10, 2006 (JP) ..... 2006-304689

(51) Int. Cl.
*G08G 1/00* (2006.01)

(52) U.S. Cl. ..... 701/117; 340/934; 340/995.13

(58) Field of Classification Search ..... 701/117–119
See application file for complete search history.

(56) References Cited

U.S. PATENT DOCUMENTS 3,239,653 A * 3/1966 Barker ..... 701/118
3,239,805 A * 3/1966 Brockett ..... 340/934
3,389,244 A * 6/1968 Brockett ..... 701/118
5,173,691 A * 12/1992 Sumner ..... 340/905
5,182,555 A * 1/1993 Sumner ..... 340/905
5,812,069 A * 9/1998 Albrecht et al. ..... 340/905
5,822,712 A * 10/1998 Olsson ..... 701/117
6,222,836 B1 * 4/2001 Sekiyama et al. ..... 370/351
6,329,932 B1 12/2001 Fastenrath
6,462,697 B1 * 10/2002 Klamer et al. ..... 342/36
6,466,862 B1 * 10/2002 DeKock et al. ..... 701/117
6,574,548 B2 * 6/2003 DeKock et al. ..... 701/117
6,785,606 B2 * 8/2004 DeKock et al. ..... 701/117

(Continued)

FOREIGN PATENT DOCUMENTS

EP 1 061 491 A1 12/2000

(Continued)

OTHER PUBLICATIONS

European Search Report dated Oct. 23, 2008 (Seven (7) pages).

(Continued)

*Primary Examiner*—Thomas G Black
*Assistant Examiner*—Shelley Chen
(74) *Attorney, Agent, or Firm*—Crowell & Moring LLP

(57) ABSTRACT

In a traffic information system, the principal component analysis of the floating car data collected in the past is performed for each traffic area. From among the bases representing the traffic data collected on the road-links in the traffic area, the bases which have strong correlation to the road-links on which real-time traffic data were collected are selected. The weighting coefficients for the selected bases are calculated by projecting the real-time traffic data onto the selected bases. The traffic estimation data are calculated by linearly combining the selected bases with the obtained weighting coefficients as the coefficients of the respective bases. The calculated traffic estimation data are used for the interpolation of the road-links on which the real-time traffic data were not collected.

4 Claims, 16 Drawing Sheets

U.S. PATENT DOCUMENTS

| | | | | |
|---|---|---|---|---|
| 6,882,930 | B2 * | 4/2005 | Trayford et al. | 701/117 |
| 7,143,442 | B2 * | 11/2006 | Scarfe et al. | 726/23 |
| 7,167,795 | B2 * | 1/2007 | Hirose et al. | 701/210 |
| 2002/0193938 | A1 * | 12/2002 | DeKock et al. | 701/117 |
| 2003/0073406 | A1 * | 4/2003 | Benjamin et al. | 455/41 |
| 2003/0225516 | A1 * | 12/2003 | DeKock et al. | 701/214 |
| 2004/0103021 | A1 * | 5/2004 | Scarfe et al. | 705/13 |
| 2005/0222755 | A1 * | 10/2005 | Tengler et al. | 701/201 |
| 2006/0025925 | A1 * | 2/2006 | Fushiki et al. | 701/210 |
| 2006/0058940 | A1 * | 3/2006 | Kumagai et al. | 701/117 |
| 2006/0064234 | A1 * | 3/2006 | Kumagai et al. | 701/117 |
| 2006/0206256 | A1 * | 9/2006 | Kumagai et al. | 701/117 |
| 2006/0242610 | A1 * | 10/2006 | Aggarwal | 716/1 |
| 2007/0208493 | A1 * | 9/2007 | Downs et al. | 701/117 |
| 2007/0208494 | A1 * | 9/2007 | Chapman et al. | 701/117 |
| 2007/0208495 | A1 * | 9/2007 | Chapman et al. | 701/117 |
| 2007/0208496 | A1 * | 9/2007 | Downs et al. | 701/117 |
| 2007/0208501 | A1 * | 9/2007 | Downs et al. | 701/119 |
| 2008/0030371 | A1 * | 2/2008 | Kumagai et al. | 340/905 |
| 2008/0046165 | A1 * | 2/2008 | Downs et al. | 701/117 |
| 2008/0071465 | A1 * | 3/2008 | Chapman et al. | 701/117 |
| 2008/0114529 | A1 * | 5/2008 | Hiruta et al. | 701/117 |

FOREIGN PATENT DOCUMENTS

| | | | |
|---|---|---|---|
| EP | 1 550 842 | A1 | 7/2005 |
| JP | 7-129893 | A | 5/1995 |
| JP | 2005-4668 | A | 1/2005 |

OTHER PUBLICATIONS

Masatoshi Kumagai, et al., "Spatial Interpolation Of Real-Time Floating Car Data Based On Multiple Link Correlation In Feature Space", Oct. 8-12, 2006, pp. 1-7, ITS World Congress, London, United Kingdom.

* cited by examiner

FIG. 6

| SECONDARY MESH NUMBER | |
|---|---|
| LINK 1 ID | 1 |
| LINK 2 ID | 0 |
| LINK 3 ID | 1 |
| ⋮ | ⋮ |
| LINK M ID | 0 |

LINK ID INTERPOLATION-AVAILABLE : 1

IINTERPOLATION-UNAVAILABLE : 0

FIG. 9

| SECONDARY MESH NUMBER | |
|---|---|
| LINK DATA | LINK 1<br>LINK 3<br>⋮<br>LINK M |
| BASIS 1 W' (1) | w11<br>w13<br>⋮<br>w1M |
| BASIS 2 W' (2) | w21<br>w23<br>⋮<br>w2M |
| ⋮ | |
| BASIS P W' (P) | wP1<br>wP3<br>⋮<br>wPM |

TRAFFIC INFORMATION INTERPOLATION SYSTEM

BACKGROUND OF THE INVENTION

This invention relates to the interpolation of traffic information.

As compared with a traffic information system which collects traffic information from roadside sensors, a floating car system can collect traffic information over a broader area at a lower cost. However, the random routes and data collecting timings of floating cars lead to a spatial and temporal deficiency in the collected floating car data (hereafter referred to as FCD for brevity). Information display or route search in a car navigation system cannot be properly performed if there are such deficiencies in the collected traffic information. Therefore, it is necessary to interpolate the FCD if they are to be used for such applications.

A technique for imputing the traffic information collected by roadside sensors is disclosed in, for example, JP-A-7-129893. According to the artifice disclosed there, deficiency in traffic information on a certain road-link is interpolated with other traffic information obtained from other road-links located upstream or downstream of, or parallel to the certain road-link, that is, by using available geographical relationships among road-links. On the other hand, JP-A-2005-004668 discloses an interpolation method which uses only FCD and does not depend on such geographical relationships among road-links and which involves statistical processing of FCD. According to this disclosure, raw FCD are first statistically processed to serve as data corresponding to the road-links of interest, and the processed data are then temporarily stored. When real-time FCD can be collected, the real-time FCD are used. When real-time FCD cannot be collected, the previously stored, statistically processed FCD are used instead. Another simple interpolation technique is also known wherein until old FCD are replaced by new FCD, the old FCD continue to be supplied as interpolation information.

Further, JP-A-2005-004668 teaches an interpolation technique for the interpolation of FCD using spatial correlation on multiple road-links. According to this technique, principal component analysis is performed on the FCD collected in the past, and correlated FCD components on plural road-links are calculated to serve as the bases related to the traffic information for those plural road-links. And the road-links on which real-time FCD were not collected are interpolated by using the bases calculated from the road-links on which real-time FCD were collected, depending on the spatially correlated FCD components on multiple road-links.

However, these conventional Interpolation techniques have the following problems. The techniques disclosed in JP-A-7-129893 and JP-A-2005-004668 documents cannot perform interpolation depending on the spatial correlation on multiple road-links if the FCD missing rate for road-links is high. For example, even in the case where 100,000 floating cars are used all over Japan, the average refresh cycle of collecting FCD is nearly once an hour per road-link. When the thus collected data are used as traffic information distributed every 5 minutes, the spatial missing rate will reach a percentage not less than 90%. Accordingly, even if the interpolation of the road-links having missing traffic information by using the traffic information of neighboring links is attempted, such an attempt will fail because situations occur frequently where the traffic information of the neighboring links are all missing as well. If the interpolation of the road-links having missing traffic information is performed by using the traffic information on remote road-links, the precision in interpolation is very poor in an area where the connections among the road-links are complicated so that the traffic information obtained through interpolation becomes far different from the actual real-time traffic information. On the other hand, if the process of statistically treating the past FCD is used, the interpolation of FCD with a high rate of link data missing is indeed possible, but the statistically processed traffic information will not exactly reflect the real-time traffic information.

According to JP-A-2005-004668, the principal component analysis of the FCD collected in the past is performed without depending on the connections among road-links so that the correlated traffic data components on plural road-links are subjected to calculations to generate the bases which represent the traffic information on the plural road-links. Further, the weighting coefficients for the bases are calculated by projecting the vector representing the real-time FCD into the space subtended by the bases. Estimated traffic information on the plural road-links is calculated by the linear combination of these bases with the thus obtained weighting coefficients used as coefficients for the bases. The real-time traffic information of the road-links having missing FCD is interpolated with the estimated traffic information. However, if the spatial missing rate of road-link data is extremely high, the amount of the link data affecting the result of interpolation is insufficient and it may happen that the precision in the resulted interpolation is poor. Since traffic condition changes at any time for various causes, the link data on the neighboring links that affect the link data of the links subjected to interpolation also fluctuates with time. So, when the link data missing rate is extremely high, it is hardly possible that the link data on the neighboring links that affect the link data of the links subjected to interpolation were sufficiently collected. If the spatial interpolation is performed with very scarce spatial samples, using the technique disclosed in JP-A-2005-004668, the resulted precision becomes poor.

Further, for example, let it be assumed that ten bases selected arbitrarily from among the bases obtained by the principal component analysis of the past interpolated FCD are used for interpolation and that an area under investigation consists of one hundred road-links. If the link data missing rate is 95%, real-time FCD can be collected on only five road-links. Accordingly, the projection of the real-time FCD onto respective bases becomes impossible. In the case where the missing rate is 90%, the number of the road-links on which real-time FCD can be collected becomes the same as the number of the selected bases. Since, however, the road-links on which real-time FCD can be collected do not necessarily have strong correlation to the selected bases, the scarcity of samples may still lead to unstable outputs.

An example of traffic information system is disclosed in U.S. patent application publication No. 2006/0206256A1. An example of the interpolation method for traffic data is disclosed in "SPATIAL INTERPOLATION OF REAL-TIME FLOATING CAR DATA BASED ON MULTIPLE LINK CORRELATION IN FEATURE SPACE", by Masatoshi Kumagai, et al., pp 1-6, ITS World Congress, 8-12 Oct. 2006".

SUMMARY OF THE INVENTION

The object of this invention is to interpolate with high precision the road-links on which real-time FCD were not collected, by using the road-links on which real-time FCD were collected, even when the number of the road-links on which real-time FCD were collected is small.

According to this invention, principal component analysis is performed on the FCD collected on each link group in the past, and the bases for the link group are calculated. Of the calculated bases, those having strong correlation to the road-links on which real-time FCD were collected are selected. The weighting coefficients of the selected bases are calculated by projecting the real-time FCD used for the selection of the bases onto the selected bases respectively. Estimated traffic data for the link group are calculated by linearly combining the selected bases with the weighting coefficients used as respective coefficients for the selected bases. These estimated traffic data are interpolated for links devoid of real-time FCD components.

This invention can be applied to provide traffic interpolation data for traffic information services which use FCD. This invention can provide high precision traffic interpolation data on the basis of the spatial correlation on road-links, especially in case where the FCD missing rate is very high.

By dynamically selecting bases depending on road-links on which real-time FCD were collected, stable and highly precise spatial interpolation results can be obtained even when the number of real-time FCD components is very small.

Other objects, features and advantages of the invention will become apparent from the following description of the embodiments of the invention taken in conjunction with the accompanying drawings.

BRIEF DESCRIPTION OF THE DRAWINGS

FIG. 6 shows an example of road-link data stored in a road-link data memory unit;

FIG. 9 shows an example of degenerate basis data stored in a degenerate basis memory unit;

DESCRIPTION OF THE EMBODIMENTS

A traffic data interpolation system as an embodiment of this invention will now be described with reference to the attached drawings, wherein plural bases representing the traffic data correlated among road-links are calculated from the FCD accumulated in the past; specific bases are dynamically selected from among the calculated bases by using road-links (hereafter referred to simply as link or links in singular or plural form, respectively) on which real-time FCD can be collected; and the links on which real-time FCD were not able to be collected are interpolated with other links on which real-time FCD were able to be collected.

Embodiment 1

Figure 1:
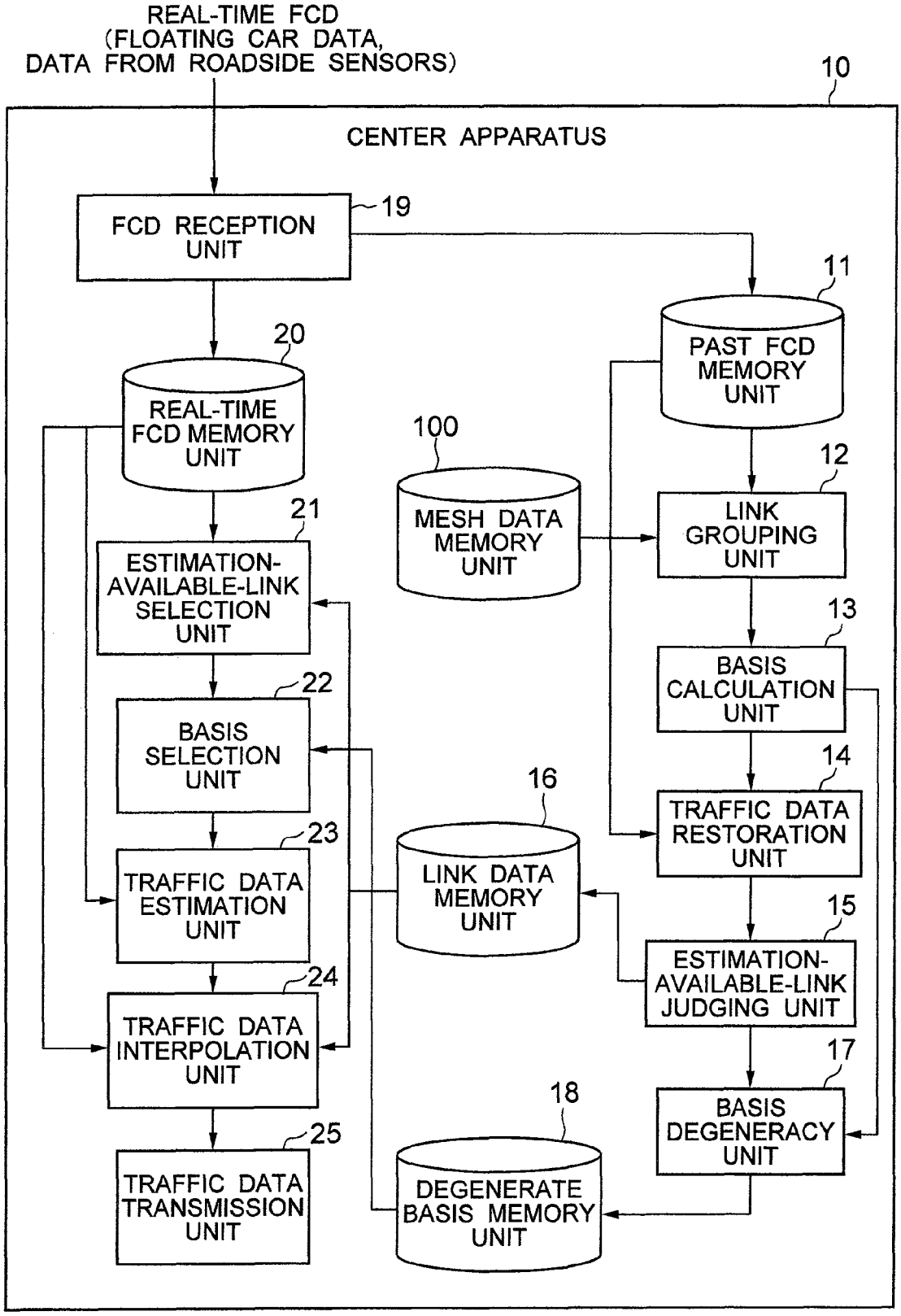
FIG. 1 is a functional block diagram for a traffic data collection/transmission system as an embodiment of this invention.

FIG. 1 is a functional block diagram for a traffic data collection/distribution system as an embodiment of this invention. As Shown in FIG. 1, the traffic data collection/distribution system consists mainly of a center apparatus 10. The center apparatus 10 comprises a past FCD memory unit 11; a basis calculation unit 13; a link grouping unit 12; a traffic data restoration unit 14; an estimation-available-link judging unit 15; a link data memory unit 16; a basis degeneracy unit 17; a degenerate basis memory unit 18; an FCD reception unit 19; a real-time FCD memory unit 20; an estimation-available-link selection unit 21; a basis selection unit 22; a traffic data estimation unit 23; a traffic data interpolation unit 24; a traffic data transmission unit 25; and a mesh data memory unit 100.

In the center apparatus 10, the past FCD memory unit 11 stores the FCD received by the FCD reception unit 19 in the past. The stored, past FCD are administrated by the link IDs attached to the links on which the FCD were collected. The link grouping unit 12 groups links stored in the past FCD memory unit 11 into link groups each belonging to its specific mesh, by using the mesh data memory unit 100 which stores the data about the correspondence between an individual one of the meshes of a map serving as the process unit of FCD and the link IDs of the links contained in the individual mesh. The basis calculation unit 13 performs principal component analysis of the past FCD for the links belonging to the link groups. The basis calculation unit 13 then outputs plural bases and the associated variances representing the information quantities of the bases, each of the plural bases corresponding to each link group whose FCD components are correlated to one another.

The traffic data restoration unit 14 inputs the past FCD stored in the past FCD memory unit 11, and performs a weighted projection of the inputted past FCD onto the bases calculated by the basis calculation unit 13 to obtain the weighting coefficient for the bases, so that the past traffic data are restored. The estimation-available-link judging unit 15 calculates the restoration errors for respective links on the basis of the past FCD stored in the past FCD memory unit 11 and the restored past FCD supplied from the traffic data restoration unit 14, and compares the restoration errors with a preset threshold, and as a result the link whose restoration error exceeds the threshold is not regarded as the estimation-available link while the link whose restoration error does not exceed the threshold is regarded as the estimation-available link. The link data memory unit 16 stores data on the estimation-available link and the estimation-unavailable link, which are both outputted from the estimation-available-link judging unit 15, as the flags attached to the link IDs associated with these links. The basis degeneracy unit 17 derives the degenerate bases and the variances for them, the bases being obtained by eliminating the components associated with the estimation-unavailable links outputted from the estimation-available-link judging unit 15, from the bases for each link group outputted from the basis calculation unit 13. The degeneracy basis memory unit 18 stores the degenerate bases and their variances outputted from the basis degeneracy unit 17.

In this center apparatus 10, the processes carried out by the blocks, from the basis calculation unit 13 through the basis degeneracy unit 17, are supposed to be performed offline. Further, the processes carried out by the blocks, from the basis calculation unit 13 through the basis degeneracy unit 17, generate the bases for the link groups created by the link grouping unit 12.

The FCD reception unit 19 receives real-time FCD from floating cars or roadside sensors, and sends them to the real-time FCD memory unit 20 for storage. The estimation-available-link selection unit 21 extracts the real-time FCD for the estimation-available links from the associated link IDs stored in the link data memory unit 16, the data on the flags for the estimation-available and -unavailable links, and the real-time FCD stored in the real-time FCD memory unit 20. The basis selection unit 22 inputs the group of bases and their variances stored in the estimation-available-link selection unit 21 and the real-time FCD stored in the real-time FCD memory unit 20, and dynamically selects plural bases from the group of bases. Here, the selection of bases is such that the bases having strong correlations to the links on which the real-time FCD are collected are preferentially selected. The traffic data estimation unit 23 calculates the weighting coefficients of the bases selected by the basis selection unit 22 and further calculates the estimated traffic data on the basis of the weighting coefficients of the bases. The traffic data interpolation unit 24 compares the real-time FCD stored in the real-time FCD memory unit 20 with the estimated traffic data outputted from the traffic data estimation unit 23, and outputs estimated traffic data serving as interpolation data for the links on which no real-time FCD were collected. The traffic data transmission unit 25 transmits the interpolation data for traffic information to a terminal on a vehicle or a traffic data center. In this center apparatus 10, the processes carried out by the constituent blocks from the FCD reception unit 19 through the traffic data transmission unit 25 are supposed to be performed online.

The center apparatus 10 is constituted of a computer including a CPU (not shown) and related memory devices (not shown), and all the functions of the functional blocks of the central apparatus 10 can be performed by executing specific programs stored in the memory devices according to the commands from the CPU. The memory devices may be in the form of RAM, non-volatile memory or hard disk drive.

Figure 2:
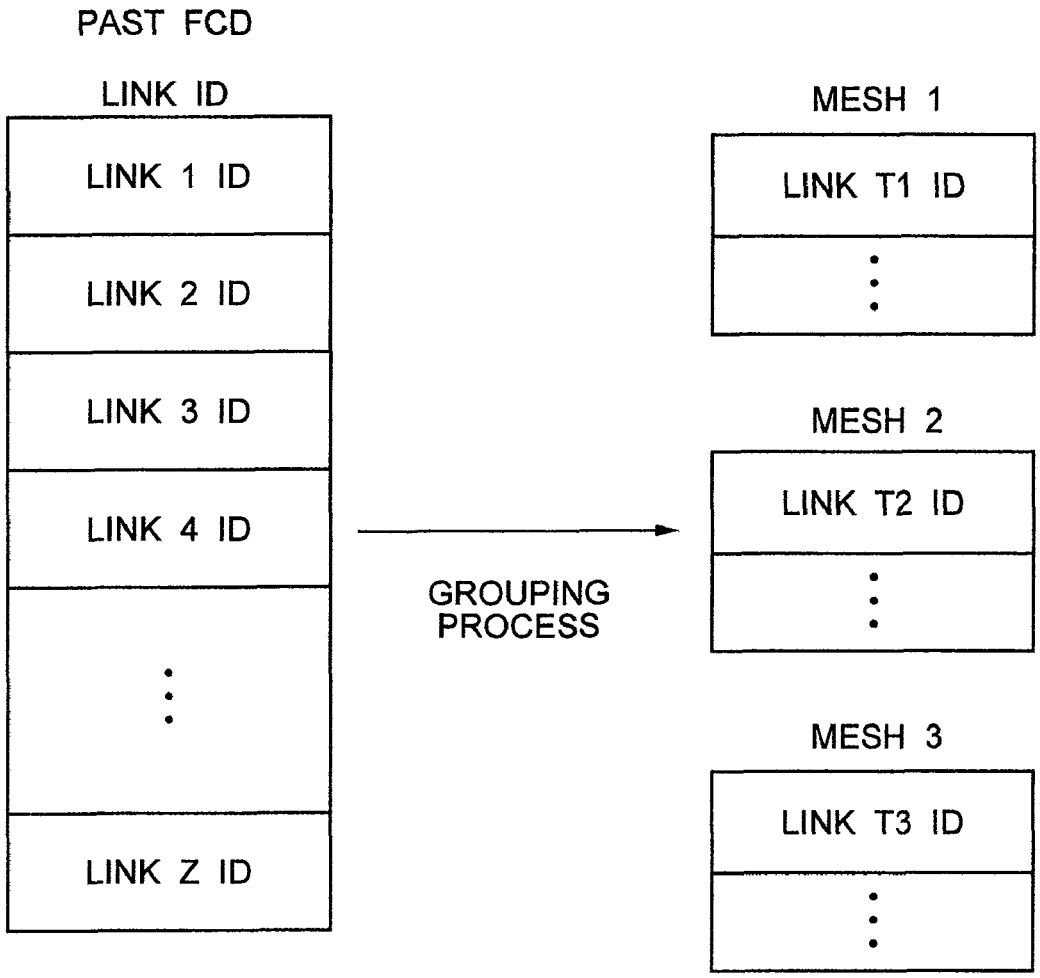
FIG. 2 schematically shows a grouping process for road-links.
Figure 2:
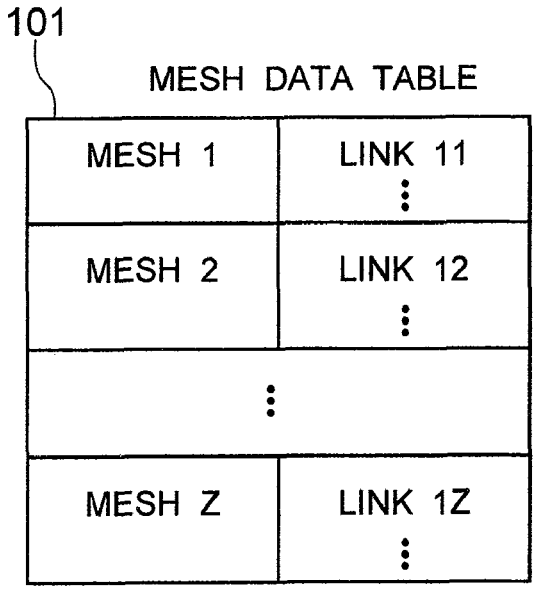

The link grouping unit 12 will now be described in detail. Prior to the calculation of bases, the link grouping unit 12 performs a process for grouping the link IDs stored in the past FCD memory unit 11 into plural groups by using the mesh data stored in the mesh data memory unit 100. The link list, i.e. list of link IDs, stores the numbers, i.e. link IDs, specific to the links on which the FCD are collected. FIG. 2 schematically shows a process for grouping the link list data, i.e. link IDs, stored in the past FCD memory unit 11 into plural groups. The mesh data table 101 stored in the mesh data memory unit 100 contains the mesh numbers of the meshes constituting the map mesh covering the area from which FCD are collected, each individual mesh including the link numbers, i.e. link IDs, specific to the links included in the individual mesh. Then, by using these mesh data, the link IDs stored in the past FCD memory unit 11 are grouped under the secondary meshes specific to them.

Figure 3:
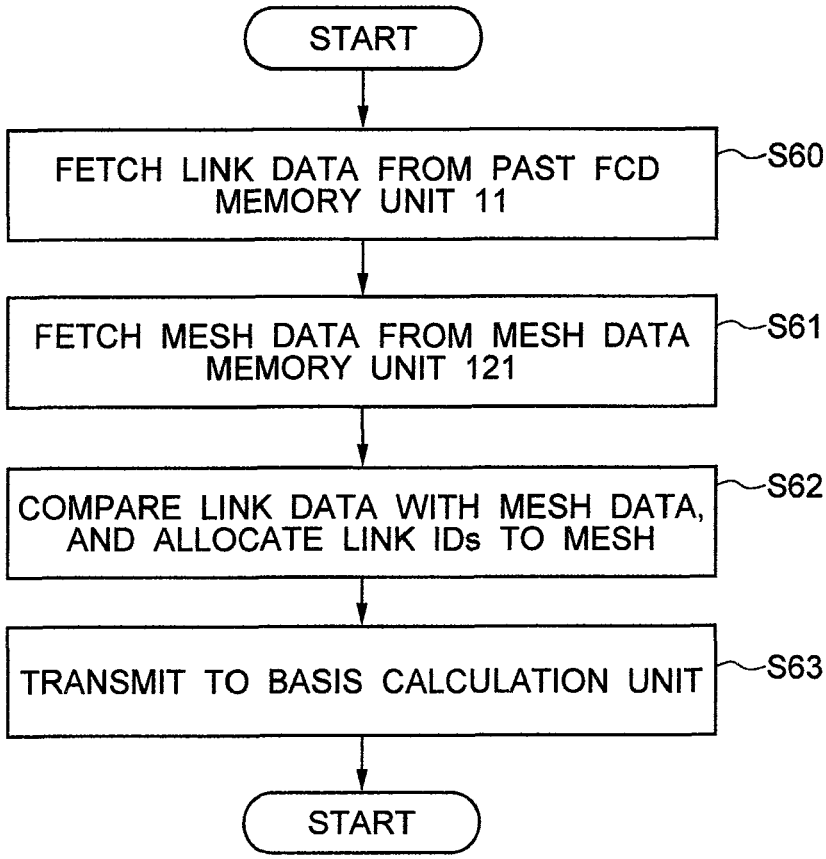
FIG. 3 shows a process flow for a road-link grouping unit.

The map mesh is a square area in a map cut up based on the longitudes and latitudes, and the secondary mesh is in the form of a square having its side of 10 km, confined between latitudes five minutes distant from each other and between longitudes seven minutes thirty seconds distant from each other. The tertiary mesh is a sub-area formed by dividing the secondary mesh into ten smaller subunits along the latitude and longitude. Each tertiary mesh is in the form of a square having its side of 1 km, confined between latitudes thirty seconds distant from each other and between longitudes forty five seconds distant from each other. FIG. 3 shows a process flow for a link grouping unit 12. Link data are fetched from the past FCD memory unit 11 (Step S60), and mesh data are fetched from mesh data memory unit 100 (Step S61). The link data obtained in Step 60 are compared with the mesh data obtained in Step S61, and link IDs are allocated to meshes such that each particular mesh contains its associated link IDs (Step S62). In order to obtain plural link groups, i.e. meshes containing their respective link IDs, through grouping process performed on the past FCD, the secondary meshes are used as described above. However, link grouping is not limited to the secondary mesh, but any other structure may be used if each group includes plural links. The tertiary meshes as described above or other divisions such as administrative division like county, city or township may be used as well. In the process described below, the secondary mesh having its constituent unit consisting of M links will be considered.

The basis calculation unit 13 will now be described. A sample of data to be analyzed consists of the past FCD collected at the same sampling instant. Each component of the FCD represents the degree of traffic congestion on a certain road-link, the time required to pass through the road-link, and the average speed while passing through the road-link. It is noted here that the number of links to be analyzed is equal to the number of the variables per sample. Accordingly, the past N samplings done on M links for data collection provide a collection of FCD consisting of N samples each having M variables. The principal component analysis is performed on these data to generate P (P<<M) bases, W(1)~W(P). The linear combination of these bases obtained by the principal component analysis can approximate any sample of the original FCD. Each basis consists of M elements which correspond to the respective variables of the original FCD, and each basis consists of elements which are correlated components of the original data. Namely, when traffic data collected on links 1~M at sampling time n are represented by a traffic data vector X(n)=[x(n, 1), x(n, 2), . . . , x(n, M)] and when p-th basis is given by a basis vector W(p)=[w(p, 1), w(p, 2), . . . , w(p, M)], then $$X(n) \approx a(n,1) \times W(1) + a(n,2) \times W(2) + \ldots + a(n,P) \times W(P) v \quad (1)$$

In the expression (1), a(n, p) is the weighting coefficients for respective bases in the linear combination thereof, x(n, i) is the traffic data (the degree of traffic congestion on a certain road-link, the time required to pass through the road-link, and the average speed while passing through the road-link) on the i-th link at sampling time n, and w(p, i) is the value representing the degree of the correlation for the p-th basis of the i-th link.

The formulation given just above indicates that the traffic data for a link group at any sampling time can be approximated by the linear combination of the bases associated with the link group. Incidentally, although the ordinary principal component analysis technique cannot utilize defective data to generate the bases, such bases can be generated from defective traffic data if the PCAMD (principal component analysis with missing data) technique, which is an extension of the ordinary principal component analysis technique, is employed. For each of the P (P<<M) bases obtained by the principal component analysis, variance can be used to indicate the amount of information contained in the basis. The number P of the bases is at most the number M of the links, and the number P is generally determined in such a manner that the number of bases just exceed a preset value of the accumulated contribution factor when contribution factors are added up in the descending order of magnitudes of the contribution factors. In this embodiment, the basis selection unit 22, described later, determines the number of bases according to how broadly real-time data cover area for data collection. Therefore, the number P of the bases is made equal to the number M of the links (P=M) in this embodiment. Variances are calculated in the course of principal component analysis, and the greater is a particular variance, the stronger is the correlation among the links of the associated link group. The vector Λ denoting the variances for the bases W(1)~W(P) is given by $\Lambda=[\lambda(1), \lambda(2), \ldots, \lambda(P)]$ where $\lambda(1), \lambda(2), \ldots, \lambda(P)$ are the variances for the first, second, . . . , P-th bases.

Figure 4:
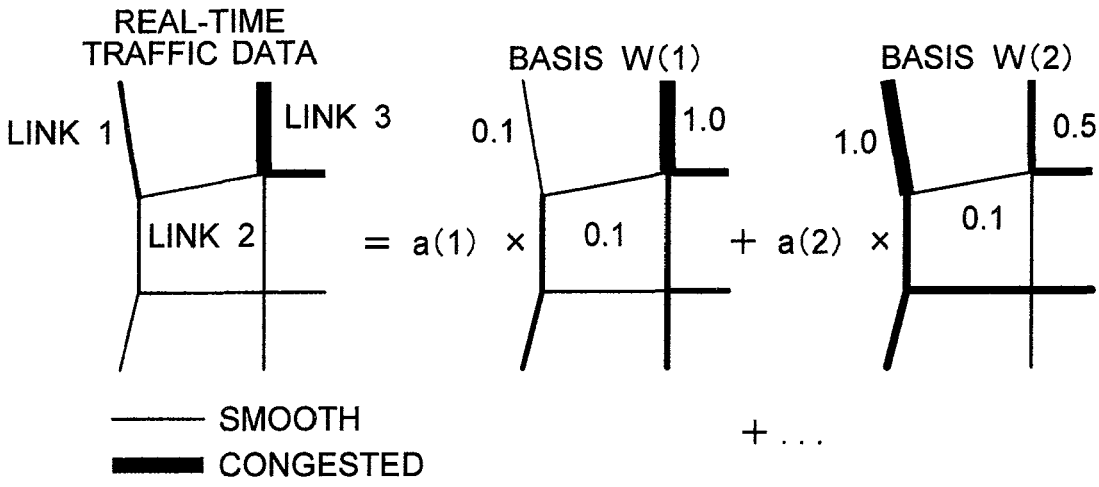
FIG. 4 pictorially shows an example of analytical process performed by a basis calculation unit.

FIG. 4 pictorially shows an example of analytical process performed by the basis calculation unit 13 according to this embodiment. In FIG. 4, the left hand side of the equal sign is a pictorial representation wherein the thicknesses of the links give the traffic information values measured on the links to be analyzed at a certain instant of time (real-time traffic data). The right hand side is an equivalent representation made by a linear combination of plural bases. Each basis on the right hand side consists of the correlated components of traffic data on the respective links, but the coefficients of the respective bases varies without correlation. If the real-time traffic data are represented in this way, the real-time traffic conditions on the plural links can be indicated by the magnitudes of the coefficients of the respective bases.

The basis calculation unit 13 used in this embodiment will be described by way of a concrete example. When it is assumed that the components for the links 1, 2 and 3 of the basis W(1) are represented as [0.1, 0.1, 1.0], it means that the traffic data collected on the links 1, 2 and 3 contains the components which vary in a proportion of "1:1:10". On the other hand, if the components for the links 1, 2 and 3 of the basis W(2) are represented as [1.0, 0.1, 0.5], then the traffic data collected on the links 1, 2 and 3 also contain the components which vary in another proportion of "10:1:5". The comparison between the intensity (coefficient a(1) of the basis W(1)) of the components varying in the proportion of "1:1:10" and the intensity (coefficient a(2) of the basis W(2)) of the components varying in the proportion of "10:1:5", can indicate what the traffic conditions on the links 1, 2 and 3 are. For example, Link 3 is extremely congested as compared with links 2 and 3, or While link 1 is congested, link 2 is vacant and link 3 is slightly congested.

In order to obtain these bases through the analysis of the past traffic data, the principal component analysis technique described above is well suited for the purpose. However, that technique is not a sole one available, but the independent component analysis technique or the factor analysis technique may also be equally employed. Further, the statistical procedure used in the basis calculation unit 13 is not limited to the principal component analysis, either.

Since the purpose of the process performed by the basis calculation unit 13 is to represent the correlated components for links of the bases as numerical quantities, it is necessary to regard the correlated components for links varying on the actual road network as the units for calculating the bases. Accordingly, there are several procedures possible for selecting links to be analyzed. They may include, for example, a procedure wherein the traffic data collected on the links in a single mesh are used as analytical units for the principal component analysis of traffic data, and a procedure wherein the traffic data collected on the links selected along a trunk road are used as analytical units for the principal component analysis of traffic data. Further, there is another procedure wherein all the links contained in the past FCD memory unit 11 are grouped into link sets each consisting of M links, and FCD data are extracted from the link sets. Each link set consisting of M links corresponds to a secondary mesh. Here, it is assumed that the M links belong to the T-th secondary mesh.

The traffic data restoration unit 14 will now be described. Let it be first assumed that P bases are selected by the basis calculation unit 13. Now, the P bases are represented as W(1), W(2), . . . , W(P). The weighting coefficients for the respective bases necessary for traffic data restoration can be obtained by the weighted projection of the past FCD into the linear space subtended by the basis vectors W(1), W(2), . . . , W(P). If the links on which traffic data were collected are clearly distinguished from links whose traffic data are missing, as in the past FCD, then the weighting factors for the former links are set to "1" and those for the latter links to "0". Thus, the weighting coefficient for each of the respective bases is determined to restore the past traffic data.

The process for the weighted projection of the past traffic data and the determination of the weighting coefficients for the respective bases is performed on those portion of the entire past FCD stored in the past FCD memory unit 11 which were collected at the past N sampling times. Namely, the traffic data vector X(n) representing the traffic data collected on the links 1~M at sampling time n, which consists of M components x(n, 1)~x(n, M) collected on the links 1~M at sampling time n, can be expressed as the weighted projection of the bases W(1)~W(P) with weighting coefficients a(n, 1)~a(n, P), with the weighting factors "1" for the links on which FCD are collected and the weighting factors "0" for the links on which FCD are not collected. Thus, $$X(n)=a(n,1)\times W(1)+a(n,2)\times W(2)+\ldots+a(n,P)\times W(P)+e(n) \quad (2)$$

As a result, the set of weighting coefficients a(n, 1)~a(n, P) that minimize the norm of the error vector e(n) with respect to the link on which traffic data are collected, can be obtained. The weighting factors for links are not limited to "1" and "0" which correspond to the links on which FCD are collected and the links on which FCD are not collected, respectively. For example, the weighting factors may also be determined depending on the reliability and the novelty of the collected FCD.

In the case, for example, where weighting factors for links are determined depending on the reliability of FCD, the FCD collected on a real-time basis helps determine the weighting factors. The reliability for a link is assumed to be higher if the number of floating cars passing through the link is larger. So, a larger value is given to such a link of higher reliability to define traffic data of high reliability. Further, in the case where weighting factors for links are determined depending on the novelty of FCD, weighting factors are determined depending on the temporal order of sampling times at which FCD are collected. Here, a larger value is given to such a link of earlier sampling to define traffic data of novelty.

Traffic data restoration Vector X'(n) representing the restored past traffic data, i.e. X'(n)=[x'(n, 1), x'(n, 2), . . . , x'(n, M)], can be calculated from the basis vectors W(1)~W(P) and the weighting coefficients a(n, 1)~a(n, P) in such a manner that $$X'(n)=a(n,1)\times W(1)+a(n,2)\times W(2)+\ldots+a(n,P)\times W(P) \quad (3)$$

The component x'(n, i) of the vector X'(n) is the restored version (restored by the use of the expression (3)) of the traffic data x(n, i) collected on the i-th link at sampling time n. Here, traffic data restoration vectors X'(n)s for all N sampling times are calculated from the expression (3).

Figure 5:
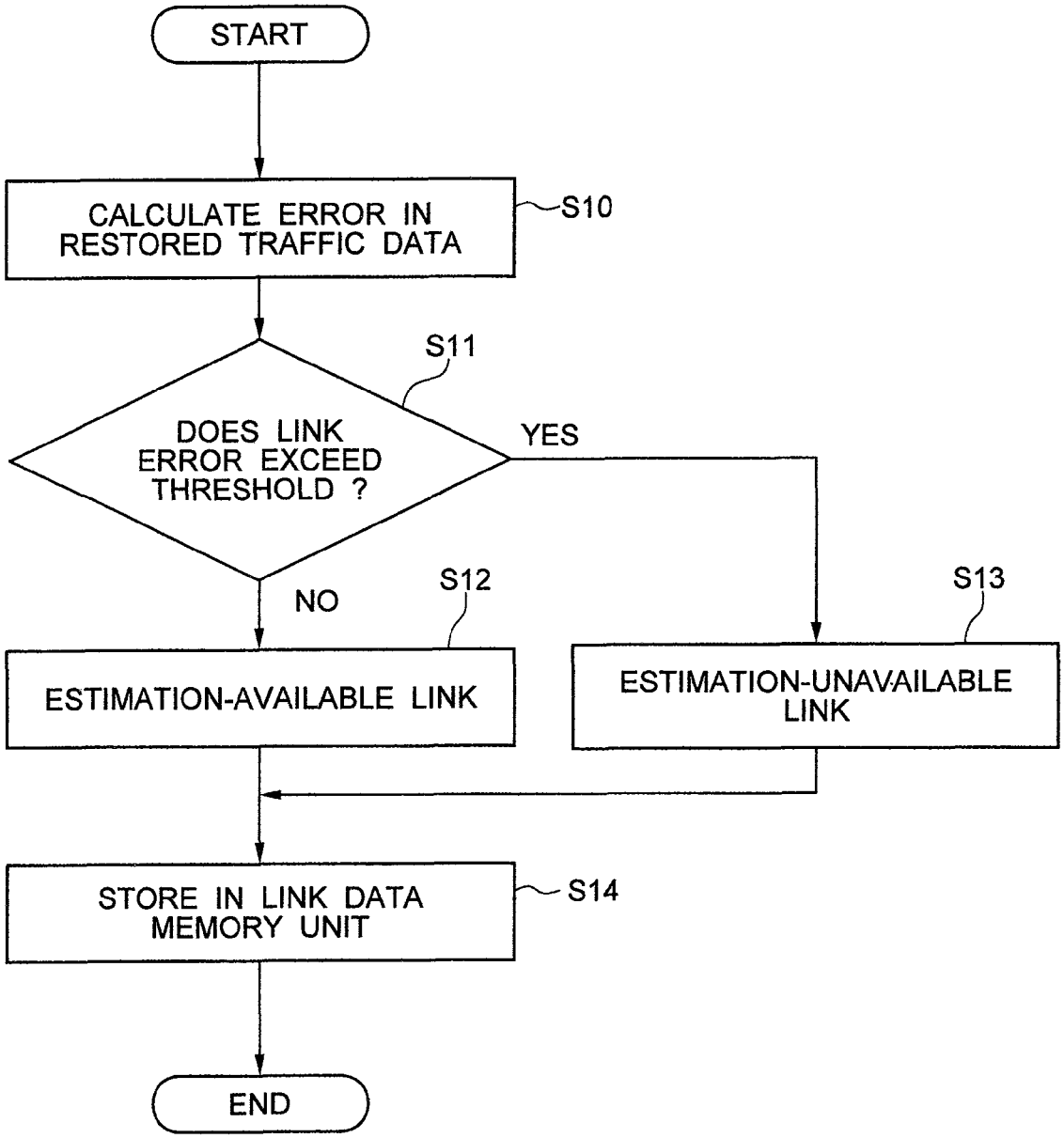
FIG. 5 shows a process flow for a traffic data restoration unit.

The estimation-available-link judging unit 15 will now be described. FIG. 5 shows a process flow for the estimation-available-link judging unit 15, included in the center apparatus 10 according to this embodiment. As shown in FIG. 5, the error evaluation of the traffic data restoration vector X'(n) calculated by the traffic data restoration unit 14 as described above is performed by assuming the past traffic data vector X(n) derived from the past FCD stored in the past FCD memory unit 11 to be of true value. This error evaluation is performed from link to link (Step S10). The results of evaluation are then compared with a threshold, and decision is made on whether the results of evaluation for the respective links exceed the threshold (Step S11). If the error for a link is smaller than the threshold, the link is assumed to be suitable for estimation process and this link is defined as an estimation-available link, i.e. a link to be subjected to estimation (Step S12). On the other hand, if the error for a link exceeds the threshold, the link is deemed unsuitable for estimation process and defined as an estimation-unavailable link, i.e. a link not to be subjected to estimation (Step S13). Then, the traffic data on the estimation-available or -unavailable links are stored in the link data memory unit 16 (Step S14). The foregoing process will be described in greater details below.

The link-wise errors in the traffic data restoration vector X'(n) outputted from the traffic data restoration unit 14 are calculated with the past FCD vector X(n) stored in the past FCD memory unit 11 assumed to be of true value (Step S10). Calculation is based on the assumption that the error E(I) in the traffic data restoration vector X'(n) for the link I is given by $$E(I)=1/n\times\Sigma(|x'(n,I)-x(n,I)|/x(n,I)) \quad (4)$$

The errors in the respective links are compared with the threshold (Step S11). For example, if the threshold is 0.6 and if the errors E(1) and E(2) in links 1 and 2 are 0.4 and 0.8, respectively, then it is determined that link 1 is an estimation-available link (Step S12) and link 2 is an estimation-unavailable link (Step S13).

The link data memory unit 16 stores the information about which links are estimation-available or -unavailable (Step S14). FIG. 6 shows an example of link data stored in the link data memory unit 16. Individual link data units are grouped under a secondary mesh. Each secondary mesh is provided with its specific number and has first blocks for storing link IDs for the individual link data units and second blocks for storing flags to indicate whether the associated individual links are estimation-available. The flags stored in the second blocks are "1s" for the links judged to be estimation-available in Step S11 and "0s" for the links judged to be estimation-unavailable in Step S11.

Figure 7:
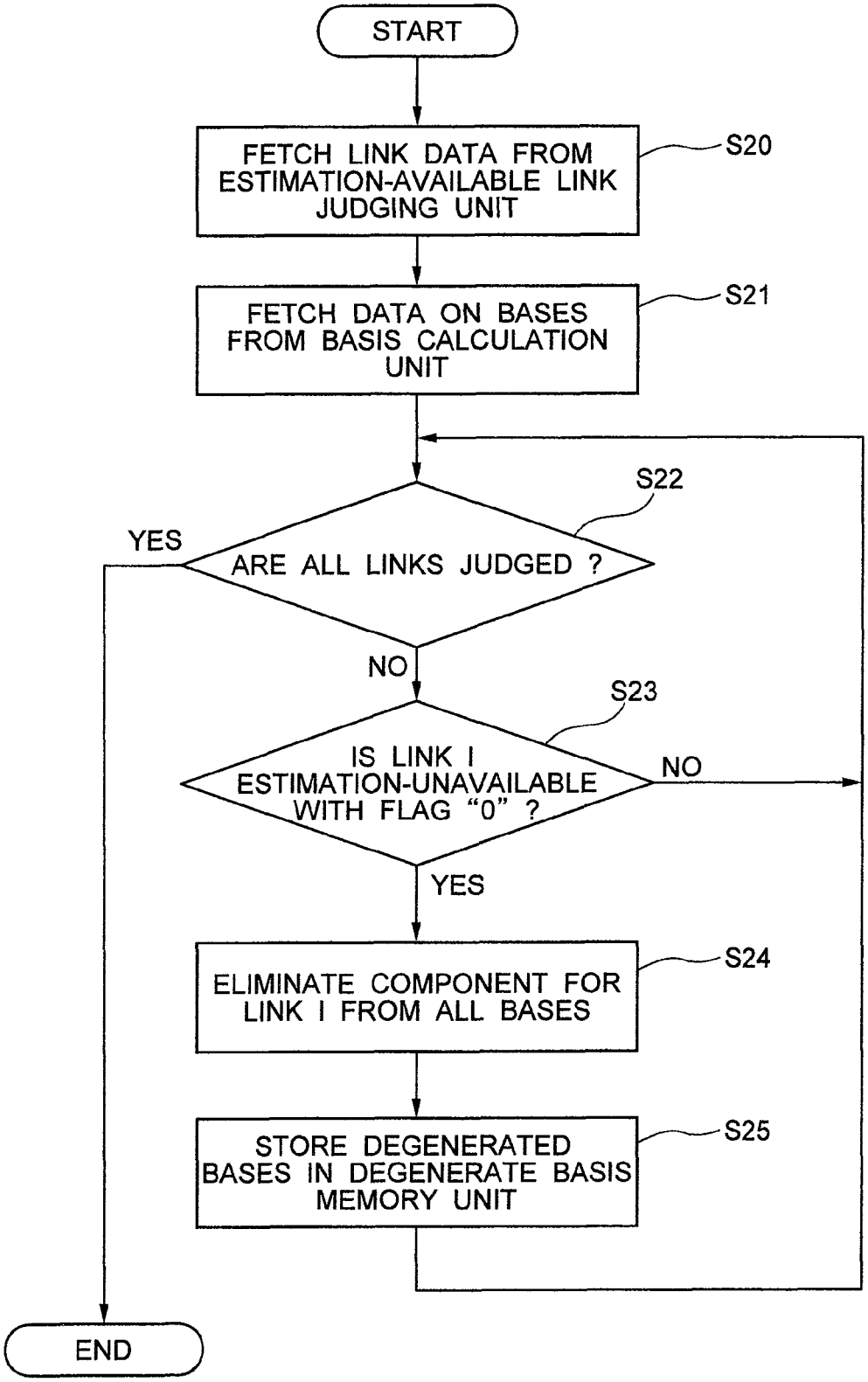
FIG. 7 shows a process flow for a basis degeneracy unit.

The basis degeneracy unit 17 will now be described. The components for the links for the links judged to be estimation-unavailable by the unit 15, are eliminated from the data on the bases calculated by the basis calculation unit 13. FIG. 7 shows a process flow for the basis degeneracy unit 17 in the center apparatus 10 according to this embodiment. First, link data on whether the link of interest is an estimation-available link or not, are fetched from the estimation-available-link judging unit 15 (Step S20). Data on the bases are fetched from the basis calculation unit 13 (Step S21). Then, judgment is made, depending on the fetched link data, on whether all the links were judged (Step S22). Namely, the process loop is repeatedly traced until all the links were judged. Depending on the fetched data on estimation-available and -unavailable links, judgment is made on whether link I is an estimation-available link having flag "1" or an estimation-unavailable link having flag "0" (Step S23). When link I has "1", the process flow returns to Step S22 so as not to eliminate the component for link I from all the bases. When, on the other hand, link I has "0", the component for link I is eliminated from all the bases contained in the mesh that is to be subjected to basis degeneracy (Step S24). Here, the component for link I indicates the I-th component w(p, I) in basis W(p). The above mentioned steps are performed for all the links. Finally, the resultant basis obtained through Step S24 is stored in the degenerate basis memory unit 18 and the whole process is renewed (Step S25).

Figure 8:
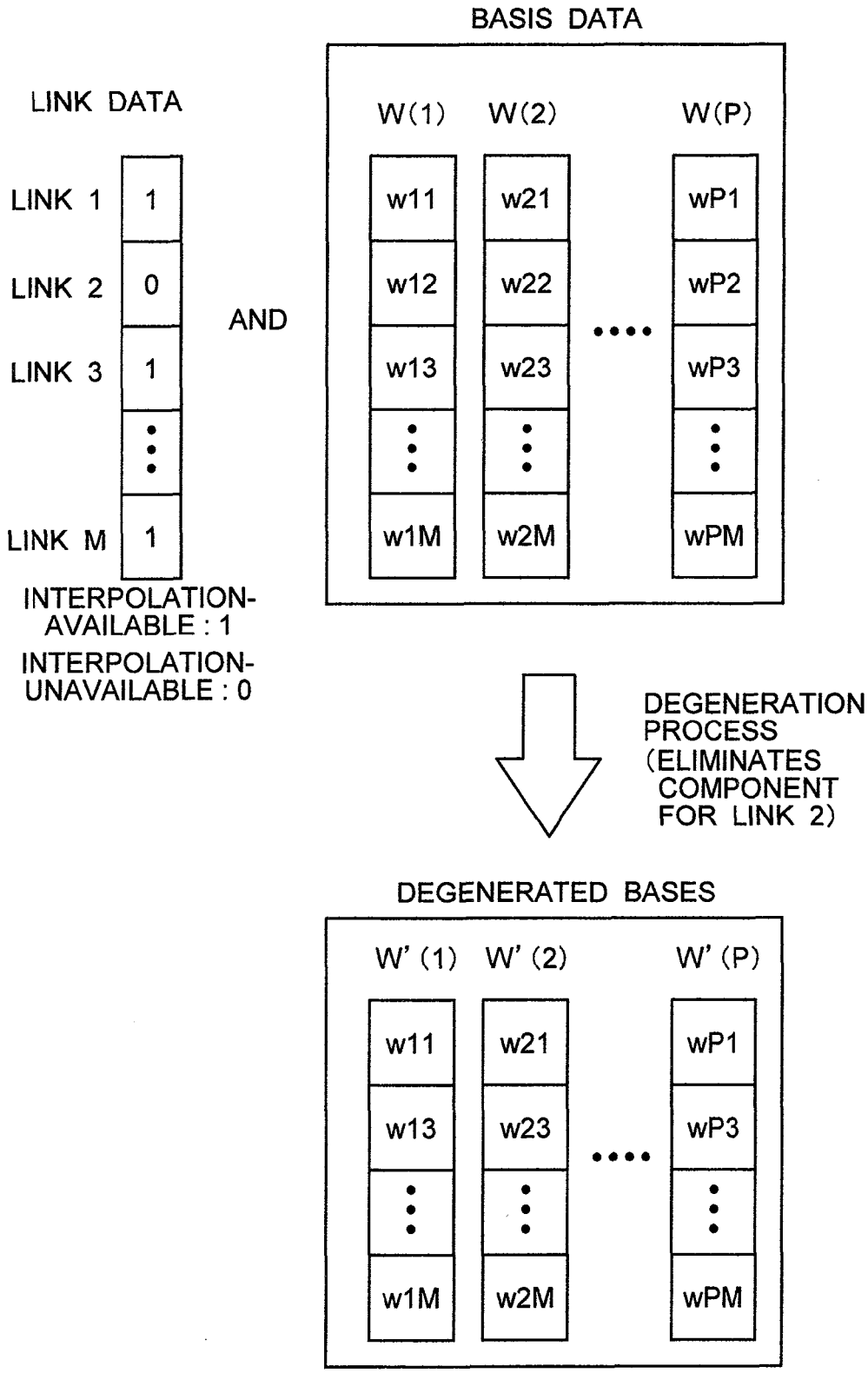
FIG. 8 shows a process of degenerating basis vectors W.

FIG. 8 shows a process of degenerating basis vectors W(1), . . . , W(P) depending on the link data outputted from the estimation-available-link judging unit 15. The link data are fetched from the estimation-available-link judging unit 15 according to the process flow shown in FIG. 7 (Step S20). The basis data are fetched from the basis calculation unit 13 (Step S21).

The link data shown in FIG. 8 shows that link 1 has flag "1" and therefore is an estimation-available link (Step S23). Accordingly, the component for link 1 is not eliminated from the basis data, and the next link is processed. The link 2 is seen to have flag "0", and the component for link 2 is eliminated from all the bases W(1), . . . , W(P). As a result of this, the degenerate bases W'(1), . . . , W'(P) can be obtained (Step S24). The thus obtained degenerate bases W'(1), . . . , W'(P) and their associated variances are stored in the degenerate basis memory unit 18 (Step S25). Here, it is noted that the variances for the bases are also degenerated in a manner similar to that used for the degeneracy of the bases.

FIG. 9 shows an example of degenerate basis data stored in a degenerate basis memory unit 18. Data on the degenerate bases are grouped under secondary meshes. The table representing a secondary mesh is provided with a number specific to the secondary mesh to which the links stored in the table belong. The mesh number is listed at the top of the table and the data on the numbers of the links after degeneracy follow. As shown in FIG. 9, the data for link 2 has been eliminated from the table as a result of degeneracy process performed in the estimation-available-link judging unit 15. The data on the degenerate bases are stored in the table, following the data on the link numbers.

The estimation-available-link selection unit 21 will now be described. This unit 21 extracts estimation-available links on the basis of the real-time FCD stored in the real-time FCD memory unit 20 and the link data store in the link data memory unit 16. The process described below will be applied for every secondary mesh available for traffic data interpolation.

Figure 10:
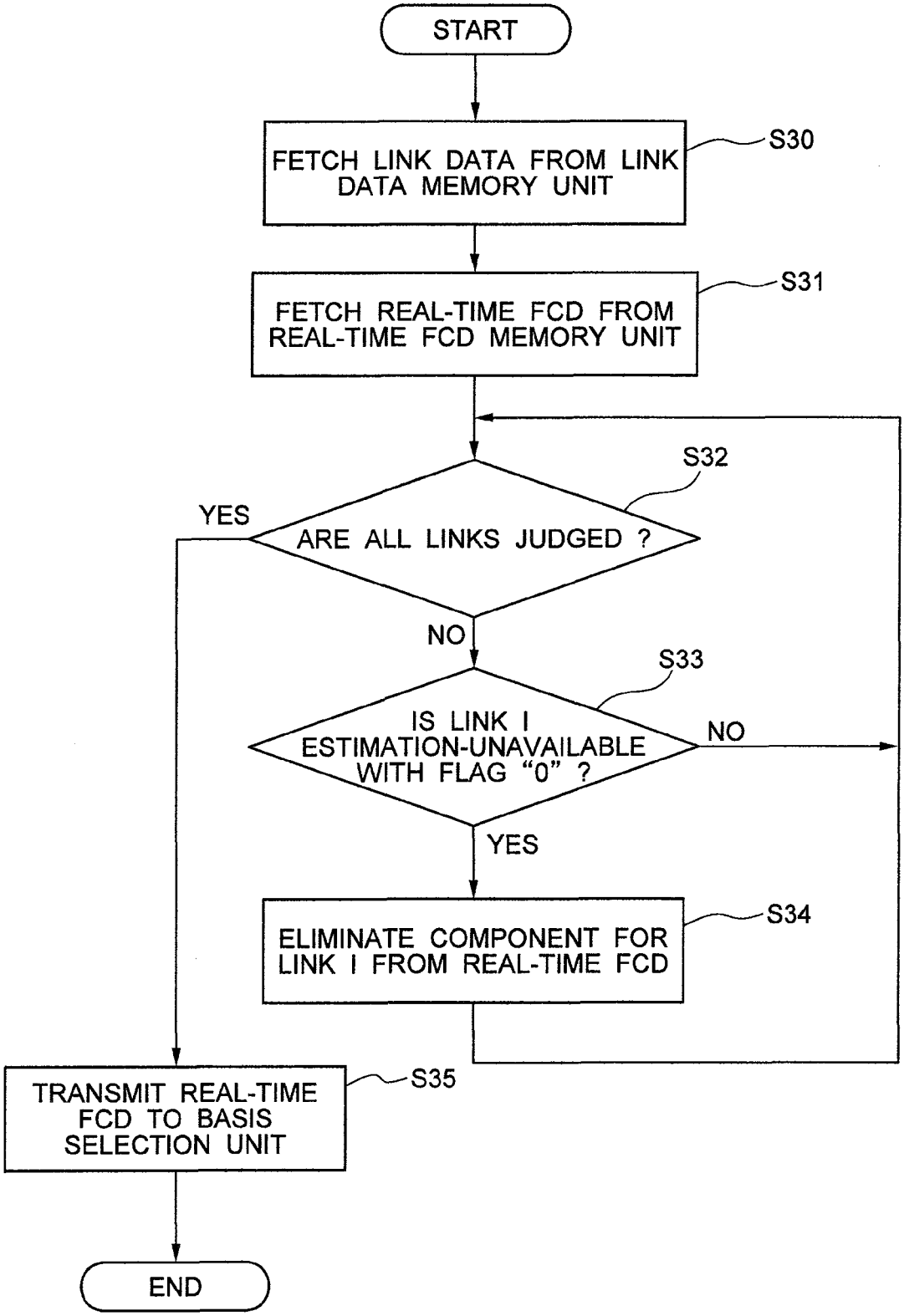
FIG. 10 shows a process flow for a basis selection unit.

FIG. 10 shows a process flow for the estimation-available-link selection unit 21 in the center apparatus 10 according to this embodiment. First, from the link data memory unit 16 are fetched the link data for determining whether the links belonging to a certain secondary mesh available for traffic data interpolation are estimation-available links or estimation-unavailable links (Step S30). Real-time FCD are fetched from the real-time FCD memory unit 20 (Step S31). Then, judgment is made on whether all the links were judged on the basis of the fetched link data, and the process loop is repeatedly traced until all the links were processed (Step S32). In the process loop, depending on the fetched link data, judgment is made on whether link I is an estimation-available link having flag "1" or an estimation-unavailable link having flag "0" (Step S33). If link I is an estimation-available link having flag "1", the judgment of the next link is initiated so as not to eliminate the component for link I from the real-time FCD. If, on the other hand, link I is an estimation-unavailable link having flag "0", the component for link I is eliminated from the fetched real-time FCD ((Step S34). When all the links were processed, the real-time FCD are transmitted to the basis selection unit 22 (Step S35).

Figure 11:
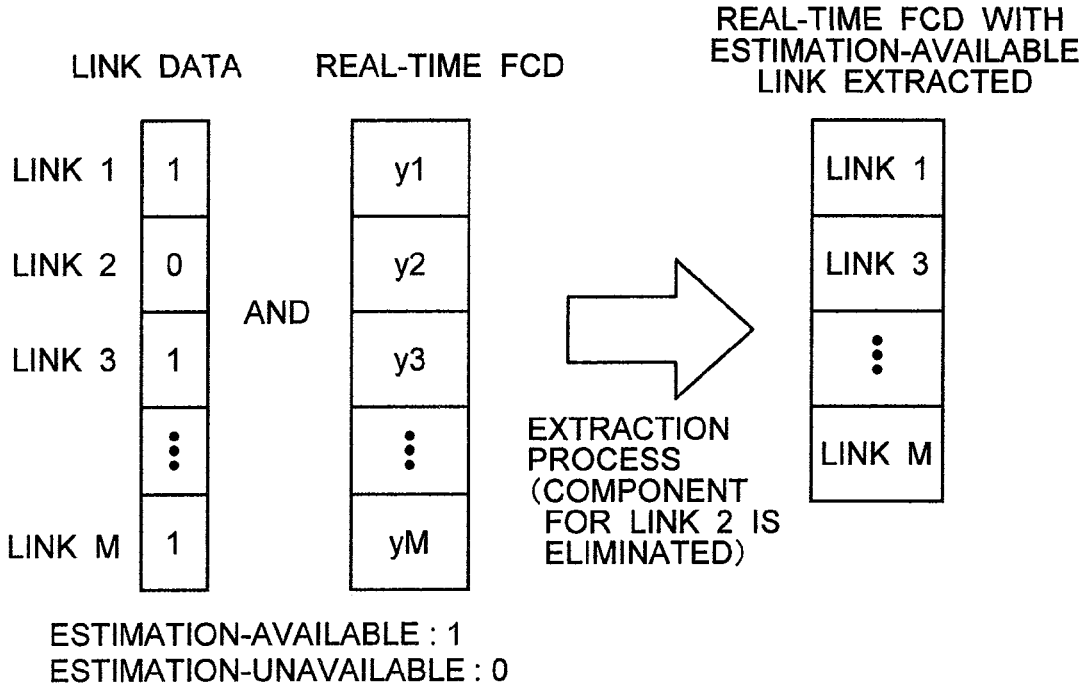
FIG. 11 shows a process of extracting a road-link to be estimated, by a road-link selection unit.

FIG. 11 shows a process of extracting estimation-available links from the real-time FCD stored in the real-time FCD memory unit 20 by using the link data available from the link data memory unit 16. Let it be assumed that the number of links belonging to a certain secondary mesh to be processed is M and that $y_i$ represents the real-time FCD component for the i-th link of the secondary mesh (i=1, . . . , M). Just as in FIG. 9, since the link 2 is an estimation-unavailable link, new real-time FCD is generated by eliminating link 2 from the real-time FCD. If a link has flag "1" (estimation-available), the data for that link remains as it is, but if a link has flag "0" (estimation-unavailable), the data for the link are eliminated. When the number of the estimation-available links is R (≦M), the number of components extracted from the real-time FCD is also R. As shown in FIG. 11, the estimation-available-link selection unit 21 transmits to the basis selection unit 22 the real-time FCD consisting of the extracted estimation-available links.

Figure 12:
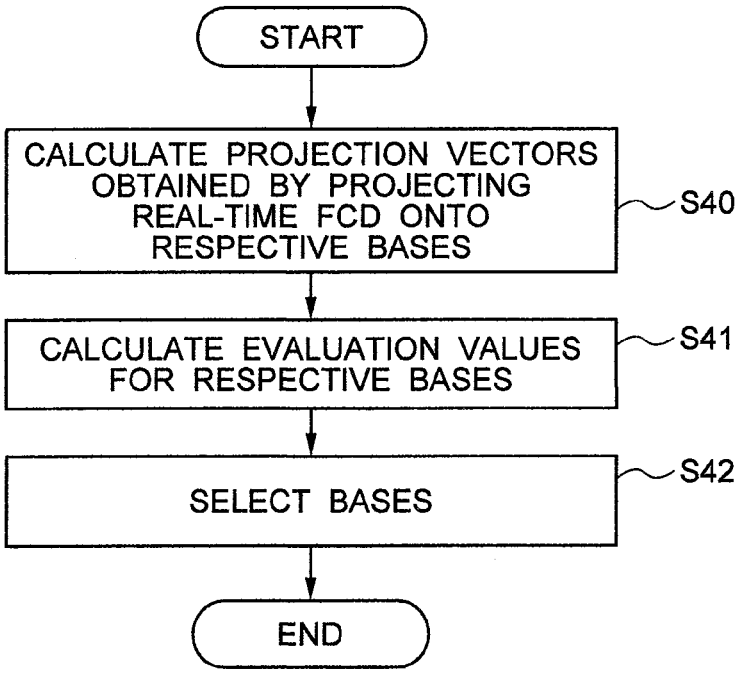
FIG. 12 shows a process flow for a basis selection unit.

The basis selection unit 22 will now be described. The process described below will be performed individually on the respective secondary meshes available for traffic data interpolation. FIG. 12 shows a process flow for the basis selection unit 22 in the center apparatus 10 according to this embodiment. As shown in FIG. 12, projection vectors are calculated for the respective bases in the secondary mesh available for traffic data interpolation, by projecting the real-time FCD stored in the real-time FCD memory unit 20 onto the respective degenerate bases stored in the degenerate basis memory unit 18 (Step S40). Then, the norms of the thus obtained projection vectors are calculated, and the respective norms are weighted with the variances of the corresponding bases stored in the degenerate basis memory unit 18 to produce the evaluation values for the respective bases (Step S41). Now, on the basis of the thus calculated evaluation values for the respective bases, plural bases having relatively higher evaluation values are selected and outputted (Step S42). The process of selecting bases are supposed to be performed dynamically every time real-time FCD are sampled for collecting link data. The above described process will be further detailed below.

A vector Y(n) is built with the R links (link 1~link R) extracted by the estimation-available-link selection unit 21 at sampling time n, such that Y(n)=[y(n, 1), y(n, 2), . . . , y(n, R)] where y(n, 1), y(n, 2), . . . , y(n, R) are link data corresponding to the respective links 1~R and where "1" is given to the link data of the link on which FCD were collected and "0" is given to the link data of the link on which FCD were not collected (Step S40). The vector Y(n) is then projected into the space subtended by the respective bases.

Figure 13:
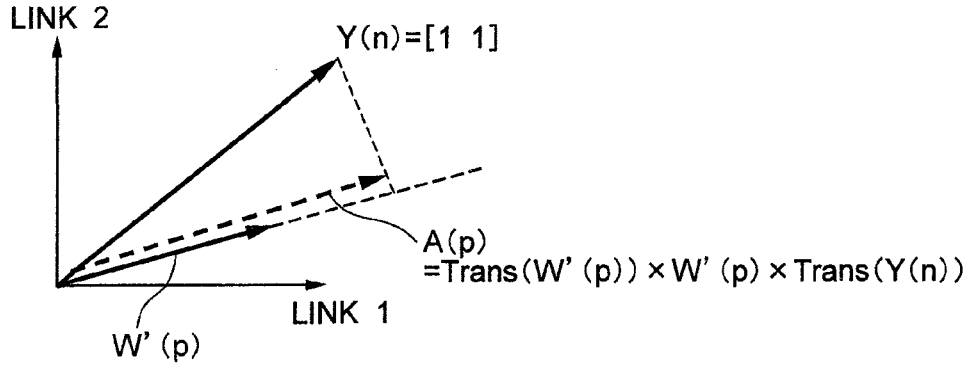
FIG. 13 shows an example of the projection of a traffic data vector onto a basis.

As shown in FIG. 13, a projection vector A(p) at sampling time n can be obtained by projecting the vector Y(n) onto the p-th basis W'(p). Thus, the projection vector A(p) is expressed as $$A(p)=\mathrm{Trans}(W'(p))\times W'(p)\times \mathrm{Trans}(Y(n)) \tag{5}$$

where Trans (W'(p)) denotes the transposed version of W'(p) expressed in terms of matrix.

An evaluation value N(p)=λ(p)^n×|A(p)| is calculated by weighting the thus obtained projection vector A(p) with the variances λ(p) for the degenerate basis W'(p) stored in the degenerate basis memory unit 18 (Step S41). The power n is a constant, and the effect of weighting with variance can be enhanced when the value for n is greater. In the following description, n is set to 1 (n=1).

Of all the bases, those plural bases which strongly reflect the real-time FCD are selected depending on the evaluation value N(p) (Step S42). The detail of this process will be concretely described below.

Figure 14:
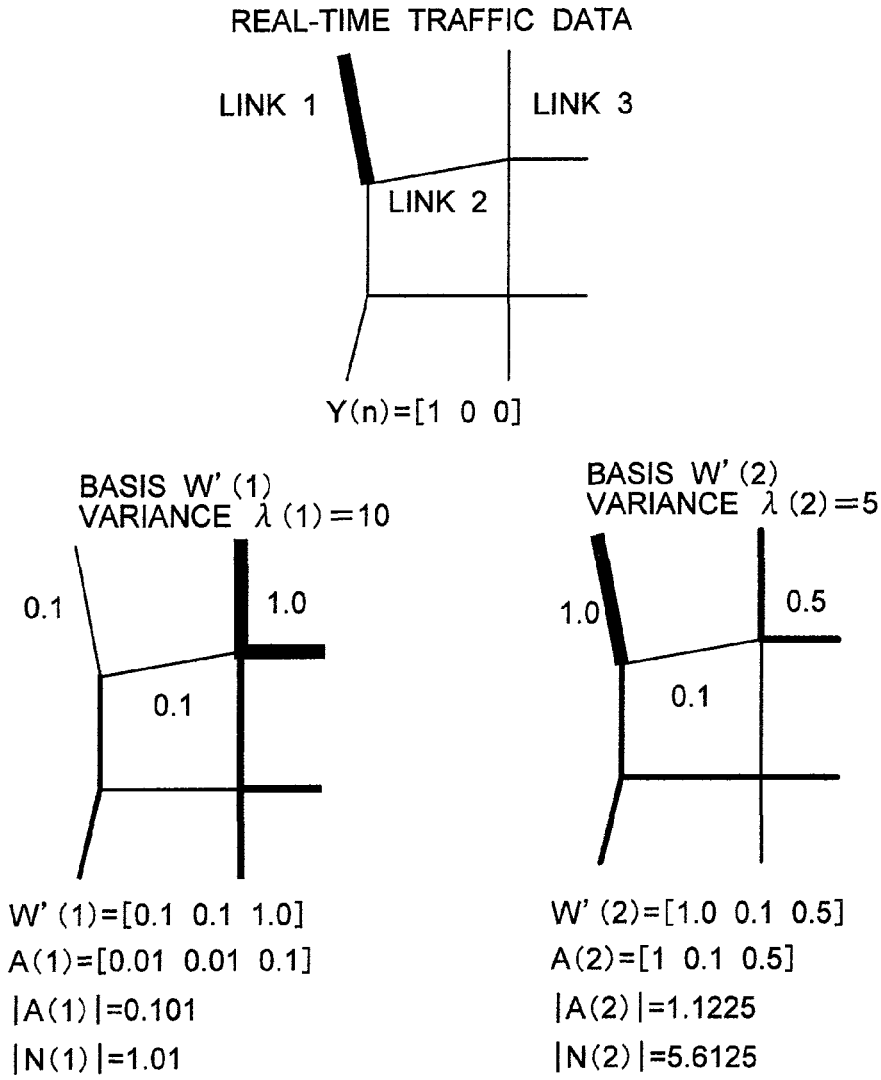
FIG. 14 pictorially shows an example of a process for selecting bases.

FIG. 14 pictorially shows an example of a process for selecting one basis from two bases W'(1) and W'(2) in the basis selection unit 22 according to this embodiment. Let it be assumed here that FCD are collected only on link 1 and no FCD are collected on links 2 and 3, that is, FCD for links 2 and 3 are missing. Accordingly, Y(n) is expressed such that Y(n)=[1 0 0]. Each basis W'(p) has its specific variances λ(p) and it is also assumed that basis W'(1) has λ(1)=10 and basis W'(2) has λ(2)=5. The projection vector A(1) obtained by projecting the real-time FCD vector Y(n) representing the real-time FCD at sampling time n onto basis W'(1) becomes A(1)=[0.01 0.01 0.1]. In like manner, the projection vector A(2) becomes A(2)=[1.0 0.1 0.5]. Accordingly, the respective evaluation values N(1) and N(2) calculated by weighting the norms of the projection vectors A(1) and A(2) respectively with the variances λ(1) and λ(2) are such that N(1)=1.01 and N(2)=5.6125. These two evaluation values N(1) and N(2) are compared with each other to select only one basis, and the result is such that N(2)>N(1). Thus, basis W'(2) is selected. This means that the basis having a greater FCD contribution to link 1 has been selected. The number of bases to be selected may be dynamically determined depending on the real-time area cover rate.

Figure 18:
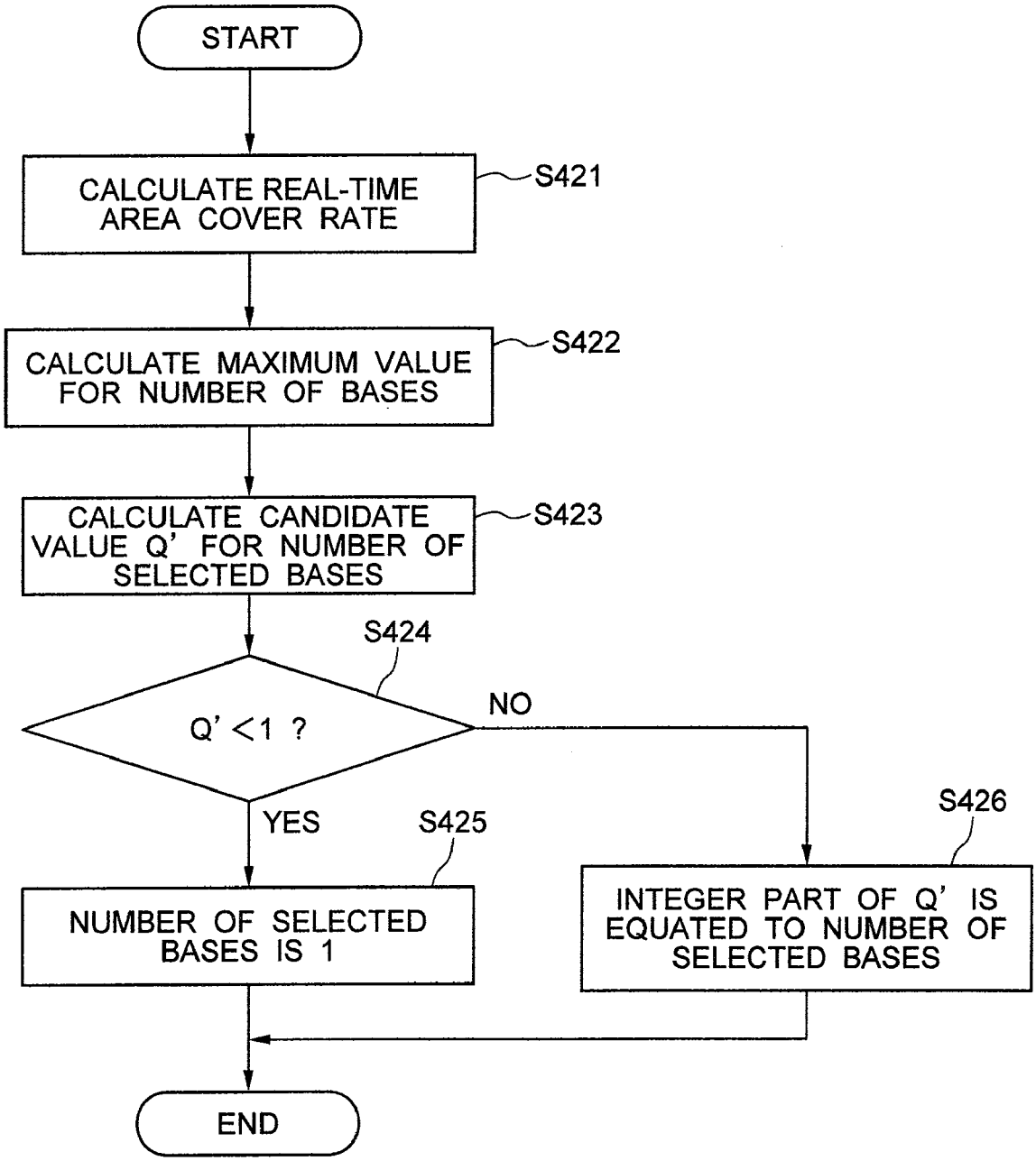
FIG. 18 shows a process flow for obtaining the number of bases to be selected.

FIG. 18 shows a process flow for obtaining the number of bases to be selected in Step S42 by the basis selection unit 22 shown in FIG. 12. The number of the links on which real-time FCD were collected is derived from the real-time FCD stored in the real-time FCD memory unit 20. This number and the number R of the links extracted by the estimation-available-link selection unit 21 are used to calculate the real-time area cover rate which indicates how many of the interpolation-available links were subjected to the effective collection of FCD component (Step S421). Then, the maximum value for the number of selected bases is determined depending on the calculated real-time area cover rate (Step S422). The thus determined maximum value is multiplied by a factor, and the resulted value (i.e. the maximum value times the factor) is used as the candidate number of bases to be selected (Step S423). Judgment is made on whether the candidate number is less than 1 (Step S424). If the candidate number is less than 1 ("Yes" route in Step S424), the number of links to be selected is made equal to 1 (Step S423). If the candidate number is not less than 1 ("No" route in Step S424), the part of the candidate number below decimal point is discarded and the rounded number, i.e. integer, is used as the number of the bases to be selected (Step S426). The above described process will be further detailed below.

Let it be assumed that R' denotes the number of the links on which real-time FCD were collected at sampling time n (Step S421). The area cover rate C (=R'/R) is calculated on the basis of the number R of the links extracted by the estimation-available-link selection unit 21. This area cover rate C is an index for indicating how many of the interpolation-available links were actually subjected to effective FCD collection. The index can take values ranging between 1 and 0.

The maximum number $Q_{max}$ of selectable bases is calculated by multiplying the area cover rate C calculated in Step S421 by the number P of the bases obtained in the basis calculation unit 13 (Step S422). For example, when the area cover rate C is 5% and the number P of the bases obtained in the basis calculation unit 13 is 110, the maximum number $Q_{max}$ of selectable bases becomes 0.05×110=5.5.

A candidate value Q' for the number of selectable bases is calculated by multiplying the maximum number $Q_{max}$ of selectable bases calculated in Step S422 by a factor e (Step S423). The factor e is a constant ranging in value between 0 and 1, with both limits 0 and 1 included. If traffic data estimation is carried out using the maximum number of selectable bases when there is an abnormal value included in real-time FCD, the result of estimation becomes unstable and the precision of estimation becomes poor as well. In order to make a robust estimation, a certain number smaller than the maximum number $Q_{max}$ must be chosen for estimation. The multiplication of the maximum number $Q_{max}$ by the factor e is for this purpose. For example, when the maximum number $Q_{max}$ is 5.5 and the factor e is 0.8, the candidate value Q' for the number of selected bases is 4.4.

Judgment is made on whether the candidate value Q' for the number of selected bases is less than 1 (Step S424).

When the 'Yes' route is taken in Step S424, that is, the candidate value Q' is less than 1, the number of selected bases is made equal to 1 (Step S425).

When the 'No' route is taken in Step S424, that is, the candidate value Q' is not less than 1, the part of the candidate number below decimal point is discarded and the rounded number, i.e. integer, is used as the number of the bases to be actually selected (Step S426). For example, when the candidate number is 4.4, the corresponding rounded number is 4 so that the number of bases actually selected is 4.

Thus, the number of bases to be selected can be variable in accordance with the area cover rate for real-time FCD. An appropriate number of bases can be selected in accordance with the number of links on which FCD are collected, by performing the process described above every sampling time n for collecting real-time FCD.

The traffic data estimation unit 23 will now be described. Let it now be assumed that Q degenerate bases were selected by the basis selection unit 22 and that the Q bases are denoted by WW(1), WW(2), . . . , WW(Q). WW(i) denotes the i-th basis selected by the basis selection unit 22 from among the Q degenerate bases. The weighting coefficients of the respective bases can be obtained by the weighted projection of real-time FCD into the linear space subtended by the vectors WW(1)~WW(Q) denoting the Q degenerate bases. For example, if the weighting values for links 1 and 2 are made large where the real-time FCD for links 1~3 of the bases W'(1) and W'(2) shown in FIG. 14 are given by [5, 1, 10], then link 1 is considered congesting and link 2 sparse. As a result, the weighting coefficient of the basis WW(2) is estimated to be larger than that of the basis WW(1). On the other hand, if the weighting value for link 3 is made larger, link 3 is considered congesting as compared with links 1 and 2. It is accordingly concluded that the weighting coefficient of the basis WW(1) is relatively large. If the links on which traffic data are collected are clearly distinguished from the links on which traffic data are missing, as in the FCD, the weighting coefficients of respective bases that reflect the real-time FCD are determined by giving a weighting value "1" to the former links and a weighting value "0" to the latter links.

Similar to X(n) denoting the past FCD, the real-time FCD is mathematically expressed in terms of vector Z such that Z=[z(1), z(2), . . . , z(R)] where z(1)~z(R) denote the FCD components for links 1~R, respectively. And of all the links 1~R, the links on which FCD were collected are weighted with "1" and the links on which FCD were not collected are weighted with "0". When the real-time FCD vector Z is projected with such weighting factors into the space subtended by the selected vectors WW(1)~WW(Q), the vector Z is given by the following expression (6):

$$Z=a(1)\times WW(1)+a(2)\times WW(2)+\ldots+a(Q)\times WW(Q)+e \quad (6)$$

In this expression (6), the weighting coefficients a(1)~a(Q) are determined such that they minimize the norm of the error vector e with respect to the links on which FCD were collected. The traffic data estimation unit 23 outputs such weighting coefficients a(1)~a(Q) to serve as weighting coefficients for real-time FCD.

The vector Z' denoting the estimated FCD defined as Z'=[z'(1), z'(2), . . . , z'(R)] is calculated by the following expression (7):

$$Z'=a(1)\times WW(1)+a(2)\times WW(2)+\ldots+a(Q)\times WW(Q) \quad (7)$$

by using the basis vectors WW(1)~WW(Q) and the weighting coefficients a(1)~a(Q). The operations of all the functional blocks, i.e. the estimation-available-link selection unit 21 through the traffic data estimation unit 23, are supposed to be performed on all the meshes stored in the link data memory unit 100.

Figure 15:
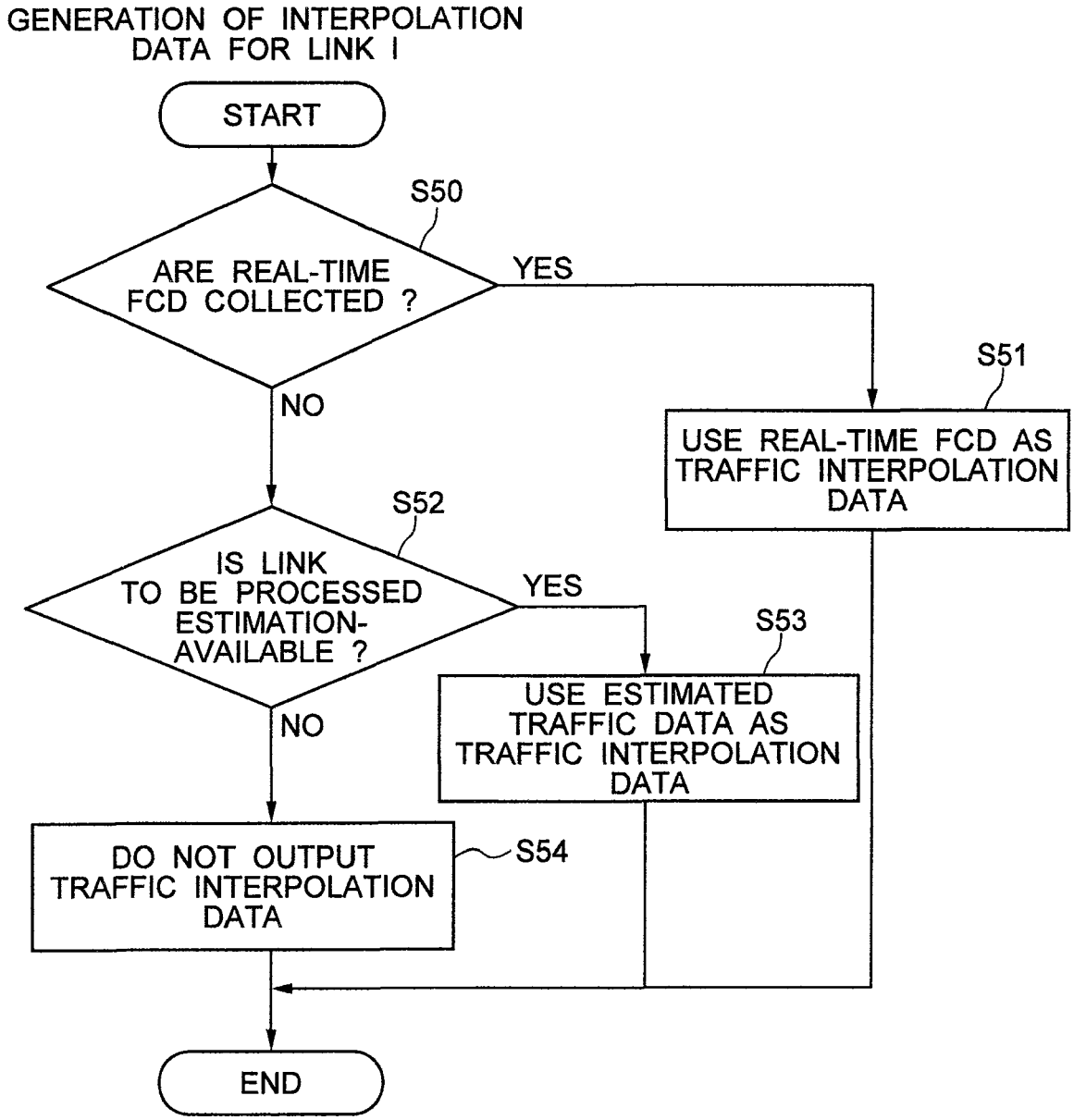
FIG. 15 shows a process flow for a traffic data interpolation unit.

The traffic data interpolation unit 24 will now be described in detail. FIG. 15 shows a process flow for the traffic data interpolation unit 24 in the center apparatus 10 according to this embodiment. The process flow shown in FIG. 15 is performed on every link that contributes to the real-time FCD.

As shown in 15, judgment is made on whether the link to be processed is the link on which the real-time FCD were collected, on the basis of the real-time FCD stored in the real-time FCD memory unit 20 (Step S50). When the link to be processed is the link on which the real-time FCD were collected ("Yes" route in Step S50), the real-time FCD are outputted as traffic interpolation data (Step S51). When, on the other hand, the link to be processed is the link on which the real-time FCD were not collected ("No" route in Step S50), the link data memory unit 16 is referred to and judgment is made on whether the link to be processed is an estimation-available link (Step S52). When the link to be processed is an estimation-available link ("Yes" route in Step S52), traffic estimation data are outputted from the traffic data estimation unit 23 as traffic interpolation data (Step S53). When, however, the link to be processed is not an estimation-available link ("No" route in Step S52), traffic interpolation data are not outputted (Step S54).

There is a method wherein when the traffic data to be processed are link travel times, the standard travel time defined as a ratio of link distance to regulated speed is outputted in Step S53. For example, if a link distance is 1000 m and the regulated speed is 50 km/h, the standard travel time is 72 sec and used as the traffic interpolation data. There is another method wherein the statistic values are calculated from the past FCD stored in the past FCD memory unit 11 and the calculated value is used as the traffic interpolation data. For example, in the case where link travel times 100, 120 and 140 seconds were collected at the past sampling times, if a simple average is regarded as a statistic value, the statistical value is 120 seconds and it is used as the traffic interpolation data.

Figure 19:
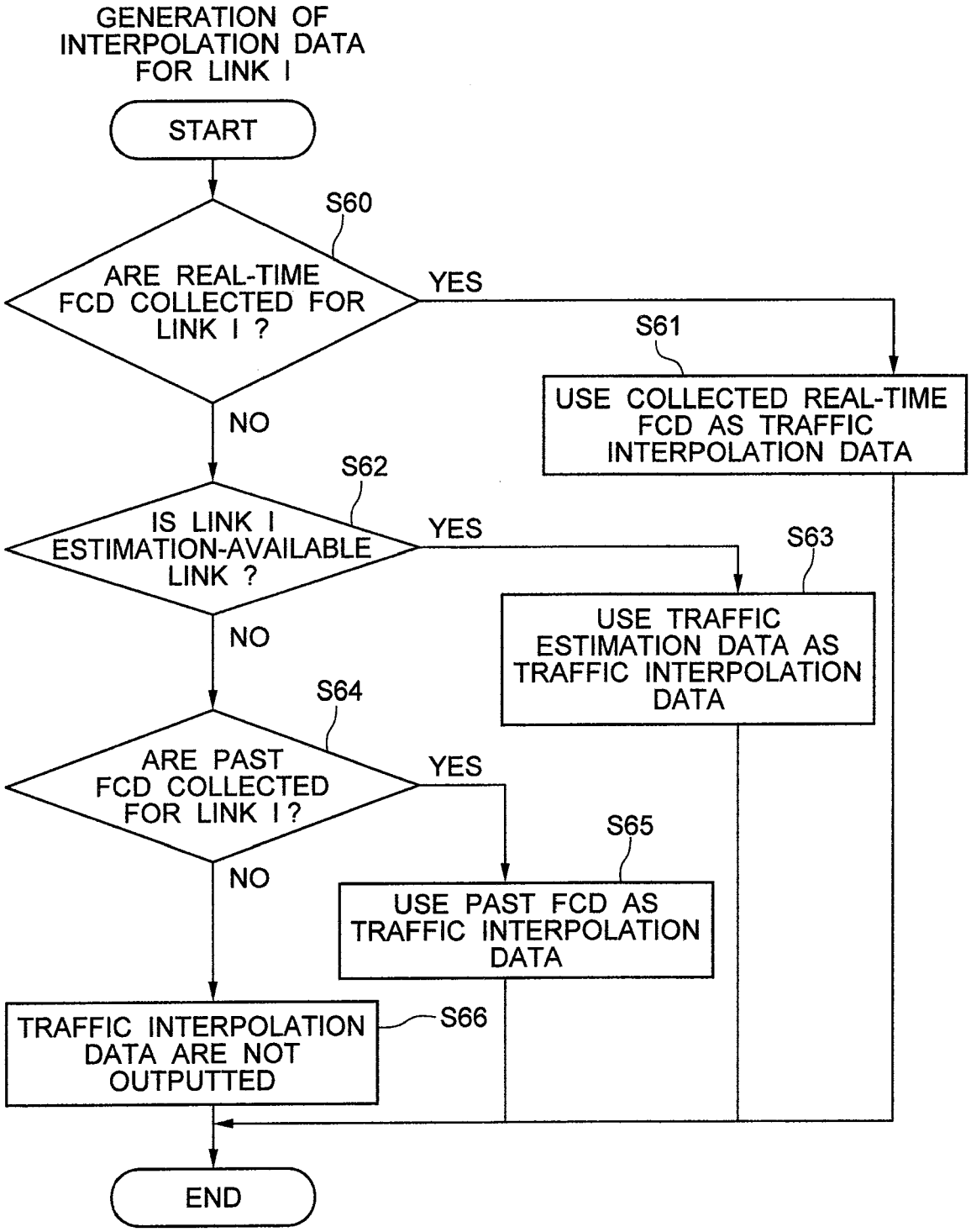
FIG. 19 shows another process flow for a traffic data interpolation unit.

There is still another method wherein the statistic value for the past FCD is outputted as the traffic interpolation data for the links on which real-time FCD were not collected and which are not estimation-available links. The process flow of this method is shown in FIG. 19. As shown in FIG. 19, judgment is made on whether or not the link to be processed is that on which traffic y data of real-time FCD were collected, on the basis of the real-time FCD stored in the real-time FCD memory unit 20 (Step S60). When the link to be processed is that on which traffic y data of real-time FCD were collected ("Yes" route in Step S60), the real-time FCD are outputted as traffic interpolation data (Step S61). When the link to be processed is that on which traffic y data of real-time FCD were not collected ("No" route in Step S60), the link data memory unit 16 is referred to and judgment is made on whether the link to be processed is an estimation-available link (Step S62). When the link to be processed is an estimation-available link ("Yes" route in Step S62), the traffic estimation data outputted from the traffic data estimation unit 23 are used as the traffic interpolation data (Step S63). When the link to be processed is not an estimation-available link ("No" route in Step S62), the past FCD memory unit 11 is referred to and judgment is made on whether FCD were collected on this link in the past (Step S64). When FCD were collected on this link in the past ("Yes" route in Step S64), the statistic value such as the average value calculated from the past FCD for this link is outputted as traffic interpolation data (Step S65). When, however, FCD were not collected on this link in the past ("No" route in Step S64), traffic interpolation data are not outputted (Step S66).

A variety of modifications and alterations for the above described embodiment will be possible. For example, in the configuration shown in FIG. 1, the traffic data received by the FCD reception unit 19 and the traffic data stored in the past FCD memory unit 11 need not be necessarily collected from floating cars, but may be collected from roadside sensors. The traffic data collected by the roadside sensors may be used as constantly collectable, highly reliable data.

Embodiment 2

Figure 16:
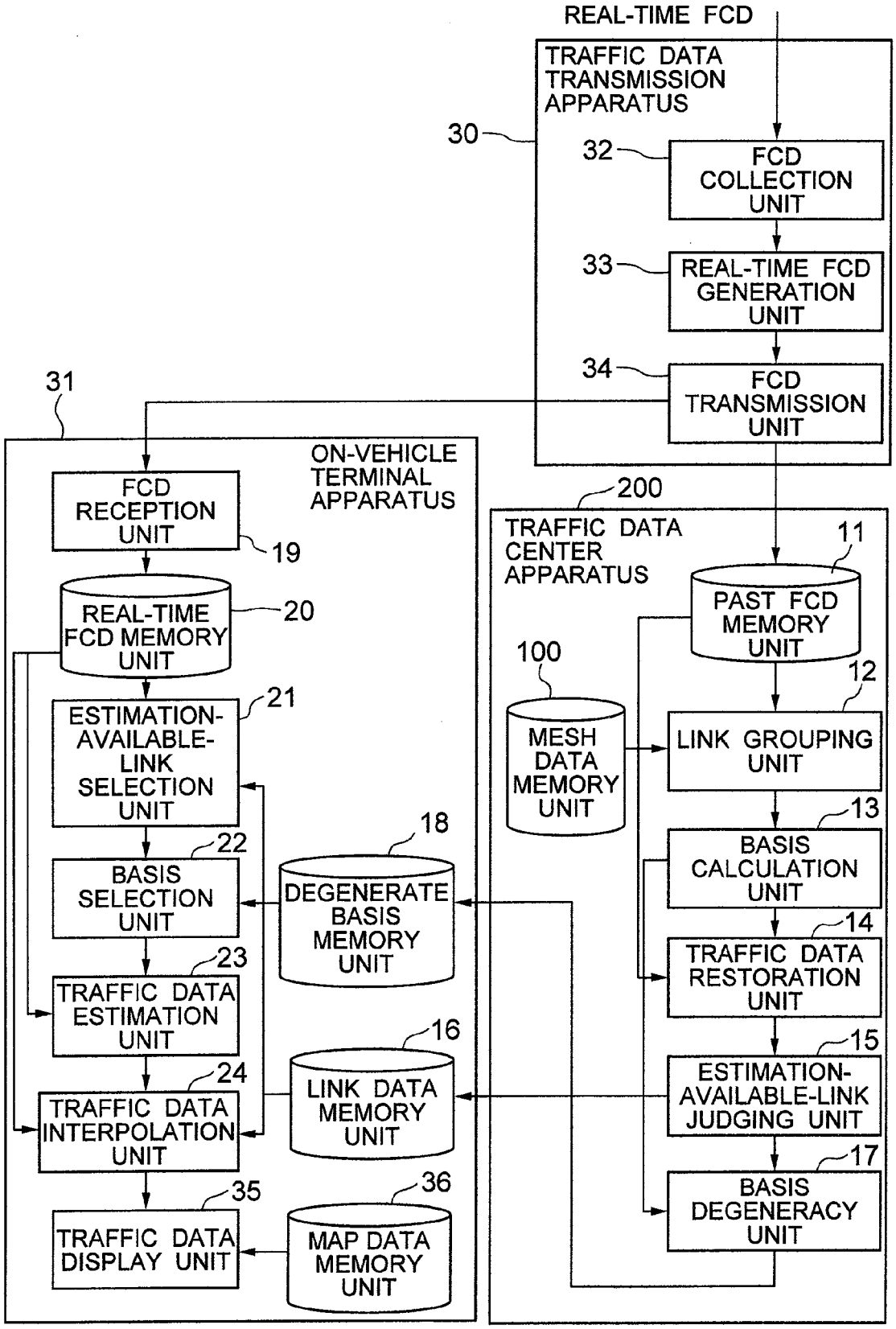
FIG. 16 is a block diagram for a traffic data system as another embodiment of this invention.

FIG. 16 shows a variation of the traffic data system as the embodiment of this invention shown in FIG. 1. In this modified embodiment, the whole system is divided into three sections: traffic data transmission apparatus 30, vehicle-borne terminal apparatus 31 and traffic data center apparatus 200. Further, the degenerate basis generation function and the link data generation function are located in the traffic data center apparatus 200, and the traffic data interpolation function is situated in the vehicle-borne terminal apparatus 31. The traffic data transmission apparatus 30 and the vehicle-borne terminal apparatus 31 can communicate with each other through communication networks (not shown) such as portable telephone channels or the Internet. Or the data transmitted from the traffic data transmission apparatus 30 may be received by the vehicle-borne terminal apparatus 31 through broadcasting channels such as FM multiple broadcasting channels or terrestrial digital broadcasting channels. The traffic data center apparatus 200 stores the traffic data transmitted through communication or broadcast in the past FCD memory unit 11. Further, the traffic data center apparatus 200 generates data on degenerate bases and estimation-available links. The data on degenerate bases are stored in the degenerate basis memory unit 18 in the vehicle-borne terminal apparatus 31, and the data on estimation-available links are stored in the link data memory unit 16 in the vehicle-borne terminal apparatus 31.

As shown in FIG. 16 and described above, the traffic data system comprises the traffic data transmission apparatus 30, the vehicle-borne terminal apparatus 31 and the traffic data center apparatus 200. The traffic data transmission apparatus 30 mainly consists of an FCD collection unit 32, a real-time FCD generation unit 33 and an FCD transmission unit 34. The vehicle-borne terminal apparatus 31 includes a traffic data display unit 35 and a map data memory unit 36 in addition to other functional blocks all equivalent to those included in the embodiment shown in FIG. 1. The traffic data center apparatus 200 includes functional blocks all equivalent to those contained in the embodiment shown in FIG. 1.

The FCD collection unit 32 of the traffic data transmission apparatus 30 receives real-time FCD transmitted from floating cars. The real-time FCD generation unit 33 generates real-time traffic data from the real-time FCD received by the FCD collection unit 32 and converts the generated real-time traffic data into a format available for transmission. The FCD transmission unit 34 transmits the real-time traffic data generated by the real-time FCD generation unit 33.

The FCD reception unit 19 of the on-vehicle terminal apparatus 31 receives the real-time traffic data transmitted by the FCD transmission unit 34. The functions of the link data memory unit 16, the degeneracy basis memory unit 18, the real-time FCD memory unit 20, the estimation-available-link selection unit 21, the basis selection unit 22, the traffic data estimation unit 23 and the traffic data interpolation unit 24 were already described with reference to FIG. 1. It is however noted that the data on the interpolation-available links stored in the link data memory unit 16 and the data on the degenerate bases stored in the degenerate basis memory unit 18, are previously calculated in the traffic data center apparatus 200. The data on the interpolation-available links and the data on the degenerate bases are supposed to be stored in their associated memories before shipping, or to be stored in place at the time of renewing the software installed in the vehicle-borne terminal apparatus 31 or through downloading by means of communication means included in the vehicle-borne terminal apparatus 31. The traffic data display unit 35 uses the traffic interpolation data generated by the traffic data interpolation unit 24 and the map data store in the map data memory unit 36, and displays desired information on a map in an overlapping manner.

Figure 17:
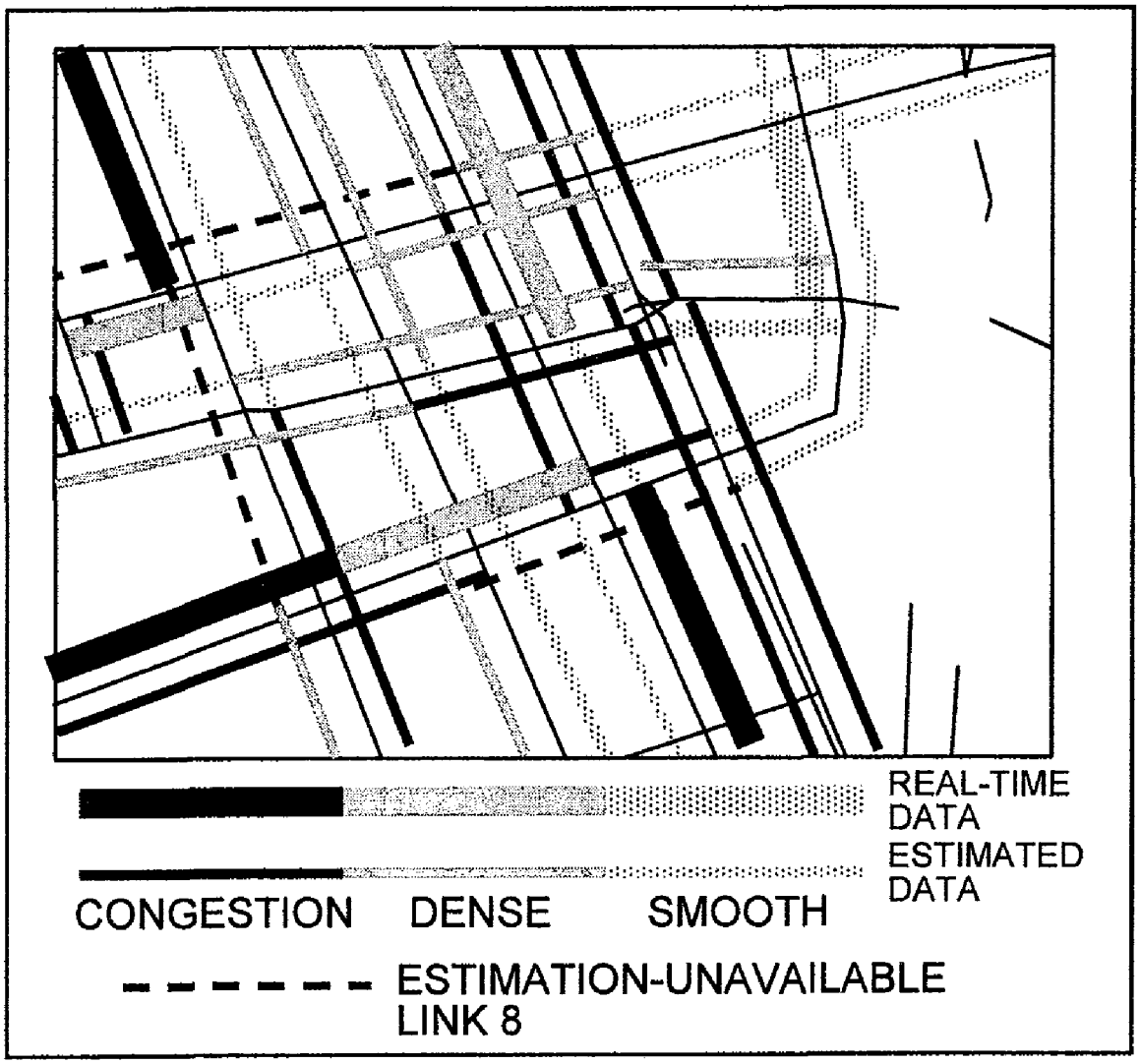
FIG. 17 shows an example of interpolated traffic data displayed on a traffic data display unit.

FIG. 17 shows an example of traffic interpolation data generated by the traffic data interpolation unit 24, displayed on the traffic data display unit 35. Real-time FCD and estimated traffic data are distinguished from each other by using road links having different thicknesses. Also, different colors are used to indicate different degrees of road crowdedness: congested, dense and sparse (or smooth). The way of distinguishing between the real-time FCD and the estimated traffic data is not limited to this example shown in FIG. 17. For example, different hues, saturations and luminosities may be used, or different kinds of line segments; solid, broken, long-and-short dashed, etc., may also be used. In this embodiment, the links deemed as estimation-unavailable links by the traffic data interpolation unit 24 are represented by dashed lines with no traffic information.

As described above, according to this embodiment, the traffic data transmission apparatus 30 transmits real-time FCD; the vehicle-borne terminal apparatus 31 dynamically selects bases stored therein depending on the transmitted real-time FCD, thereby generating traffic interpolation data; and the traffic interpolation data are displayed on the screen of a terminal. Consequently, the following advantages can be enjoyed. Traffic data interpolation process can be performed in the vehicle-borne terminal apparatus 31 so that the process load on the traffic data transmission apparatus 30 can be decreased. Since the traffic data transmission apparatus 30 dynamically collects FCD from many floating cars and generates real-time FCD, it is supposed to bear a considerable process load. Further, the traffic data transmission apparatus 30 must generate traffic data to cover a broad area (e.g. all over a country). The vehicle-borne terminal apparatus 30, on the contrary, has only to interpolate traffic data for a relatively small area such as one surrounding a vehicle with the apparatus 30 mounted thereon, or covering the destination area and the intermediate narrow areas en route to the destination. So, the process load on the traffic data center apparatus 200 can also be decreased.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A traffic data transmission method for use in a traffic information center for transmitting traffic estimation data, comprising:

a first process for receiving and storing real-time traffic data representing current traffic conditions;

a second process for generating plural bases representing spatial correlation on multiple road-links by using the principal component analysis of the traffic data stored in the past;

a third process for calculating traffic estimation data by linearly combining the generated plural bases;

a fourth process for transmitting the traffic estimation data;

a fifth process for projecting the past traffic data into the feature space subtended by the plural bases, obtaining the weighting coefficients for the plural bases, and calculating traffic estimation data by linearly combining the plural bases and the weighting coefficients;

a sixth process for calculating the precisions in the road-links of the traffic restoration data by using as true values the past traffic data from which the weighting coefficients are obtained, judging on whether the precisions in the road-links exceed a threshold, eliminating the road-links whose precisions exceed the threshold from the group of estimation-available links, and storing the information on the elimination; and a seventh process for generating degenerate bases by eliminating from the bases the traffic data components for the eliminated road-links, wherein in the third process, the weighting coefficients for the degenerate bases are obtained by projecting the real-time traffic data into the feature space subtended by the degenerate bases, and the traffic estimation data are calculated by linearly combining the degenerate bases and the weighting coefficients; and in the fourth process, the traffic interpolation data are transmitted to vehicle-borne terminals.

2. A traffic data transmission method as claimed in claim 1, wherein in the fourth process, statistic traffic data obtained by statistically processing the stored past traffic data are used when traffic data for the road-links eliminated from the group of the estimation-available road-links in the sixth process are interpolated; and traffic data interpolation is performed by using the traffic estimation data and the statistic traffic data.

3. A traffic data transmission system for use in a traffic information center for transmitting traffic estimation data, comprising:

a real-time traffic reception means for receiving and storing real-time traffic data representing current traffic conditions;

a real-time traffic data memory means for accumulating the real-time traffic data received and stored in the real-time traffic reception means;

a basis calculation means for generating plural bases representing spatial correlation on multiple road-links by using the principal component analysis of the past traffic data stored in the real-time traffic data memory means;

a traffic data estimation means for calculating traffic estimation data by linearly combining the generated plural bases;

a traffic data transmission means for transmitting the traffic estimation data;

a traffic data restoration means for projecting the past traffic data into the feature space subtended by the plural bases, obtaining the weighting coefficients for the plural bases, and calculating traffic estimation data by linearly combining the plural bases and the weighting coefficients;

an estimation-available link judging means for calculating the precisions in the road-links of the traffic restoration data by using as true values the past traffic data from which the weighting coefficients are obtained, judging on whether the precisions in the road-links exceed a threshold, eliminating the road-links whose precisions exceed the threshold from the group of estimation-available links, and storing the information on the elimination; and a basis degeneracy means for generating degenerate bases by eliminating from the bases the traffic data components for the eliminated road-links, wherein in the traffic data estimation means, the weighting coefficients for the degenerate bases are obtained by projecting the real-time traffic data into the feature space subtended by the degenerate bases, and the traffic estimation data are calculated by linearly combining the degenerate bases and the weighting coefficients; and the traffic data transmission means transmits the traffic interpolation data to vehicle-borne terminals.

4. A traffic data transmission system as claimed in claim 3, wherein in the traffic data interpolation means, statistic traffic data obtained by statistically processing the stored past traffic data are used when traffic data for the road-links eliminated from the group of the estimation-available road-links in the estimation-available link judging means are interpolated; and traffic data interpolation is performed by using the traffic estimation data and the statistic traffic data.

* * * * *

UNITED STATES PATENT AND TRADEMARK OFFICE

CERTIFICATE OF CORRECTION

PATENT NO. : 7,580,788 B2
APPLICATION NO. : 11/937668
DATED : August 25, 2009
INVENTOR(S) : Tomoaki Hiruta et al.

It is certified that error appears in the above-identified patent and that said Letters Patent is hereby corrected as shown below:

On the title page, item (*) should read:

Notice: Subject to any disclaimer, the term of this patent is extended or adjusted under 35 U.S.C. 154(b) by 26 days.

Signed and Sealed this

Seventeenth Day of November, 2009

David J. Kappos

David J. Kappos
*Director of the United States Patent and Trademark Office*